US007505703B2

(12) United States Patent
Akita et al.

(10) Patent No.: US 7,505,703 B2
(45) Date of Patent: Mar. 17, 2009

(54) RECORDING MATERIAL DISCRIMINATION DEVICE, IMAGE FORMING APPARATUS AND METHOD THEREFOR

(75) Inventors: Masanori Akita, Shizuoka (JP); Yoshitaka Kokubo, Shizuoka (JP); Tomoyuki Okada, Shizuoka (JP); Kengo Umeda, Shizuoka (JP); Masaru Aoki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 11/555,708

(22) Filed: Nov. 2, 2006

(65) Prior Publication Data

US 2007/0120945 A1 May 31, 2007

Related U.S. Application Data

(62) Division of application No. 10/950,447, filed on Sep. 28, 2004, now Pat. No. 7,149,441.

(30) Foreign Application Priority Data

Oct. 3, 2003 (JP) ..... 2003-346278
Sep. 15, 2004 (JP) ..... 2004-269028

(51) Int. Cl.
*G03G 15/00* (2006.01)
*G03G 15/20* (2006.01)

(52) U.S. Cl. ..... 399/45; 399/67; 399/389

(58) Field of Classification Search ..... 399/45, 399/67, 389; 347/156
See application file for complete search history.

(56) References Cited

U.S. PATENT DOCUMENTS 4,468,113 A 8/1984 Motohashi et al. ..... 399/45
5,138,178 A 8/1992 Wong et al. ..... 399/45 X
5,689,757 A 11/1997 Ferrante et al. ..... 399/45
5,689,760 A 11/1997 Suzuki et al. ..... 399/45

(Continued)

FOREIGN PATENT DOCUMENTS

CN 1359034 A 12/2001

(Continued)

OTHER PUBLICATIONS

Office Action issued on Mar. 16, 2007 by The Patent Office of the People's Republic of China, in Chinese Application No. 200410081061.1 with English translation.

*Primary Examiner*—Sandra L Brase
(74) *Attorney, Agent, or Firm*—Fitzpatrick, Cella, Harper & Scinto

(57) ABSTRACT

The invention is objected to perform fixing in an optimum fixing condition even with various kinds of recording materials or the like while improving usability by discriminating the kinds of recording materials. An image reading sensor 123 includes a reflective LED 301, a transmissive LED 303 disposed on the opposite side relative to a recording material 304 for detecting the transmitted amount of light, a CMOS area sensor 211, and an imaging lens 1113. The light from the reflective LED 301 as a light source is applied toward the surface of the recording material 304, and the reflected light from the recording material 304 is collected via the lens 303 and an image is formed on the CMOS area sensor 211. The LED 301 is disposed so as to apply LED light to the surface of the recording material 304 diagonally at a predetermined angle.

11 Claims, 17 Drawing Sheets

U.S. PATENT DOCUMENTS

| | | | | |
|---|---|---|---|---|
| 6,301,452 | B1 | 10/2001 | Yoshizawa | 399/45 |
| 6,381,422 | B1 | 4/2002 | Tanaka | 399/45 |
| 6,668,144 | B2 | 12/2003 | Maruyama | 399/45 |
| 6,801,727 | B2 | 10/2004 | Maruyama et al. | 399/45 |
| 6,980,749 | B2 | 12/2005 | Yoda et al. | 399/45 |
| 7,149,441 | B2 * | 12/2006 | Akita et al. | 399/45 |
| 2002/0071688 | A1 | 6/2002 | Maruyama | 399/45 |
| 2003/0052934 | A1 | 3/2003 | Maryuama | 347/16 |
| 2004/0005157 | A1 | 1/2004 | Akita | 399/45 |

FOREIGN PATENT DOCUMENTS

| | | |
|---|---|---|
| JP | 9-114267 A | 5/1997 |
| JP | 10-160687 | 6/1998 |
| JP | 2002-182518 | 6/2002 |
| JP | 2003-186264 | 7/2003 |

* cited by examiner

AREA IN $\Delta P < Q$

RECORDING MATERIAL DISCRIMINATION DEVICE, IMAGE FORMING APPARATUS AND METHOD THEREFOR

This application is a divisional of U.S. patent application Ser. No. 10/950,447, filed Sep. 28, 2004, now U.S. Pat. No. 7,149,441, issued Dec. 12, 2006.

BACKGROUND OF THE INVENTION

1. Field of the Invention

The present invention relates to a recording material discrimination device, an image forming apparatus, and a method therefor, and more specifically, to a recording material discrimination device, an image forming apparatus, and a method for detecting reflected light from the surface of a recording material and the amount of transmitted light of the recording material and discriminates the kind thereof.

2. Description of the Related Art

An image forming apparatus such as a copier and a laser printer transfers an image visualized and developed by a developing part onto a recording material and fixes the developer image by heating and pressing the image in a predetermined fixing treatment condition. Since this predetermined fixing treatment condition largely differs depending on the quality of material, thickness, or surface treatment, or the like, when plural kinds of recording materials are used, detailed settings are necessary in response to the kinds of recording materials.

Conventionally, in such an image forming apparatus, for example, the size and kind of recording material (if the recording material is paper, the kind of paper) is set by a user using an operation panel provided on the main body of the image forming apparatus or the like, and the fixing treatment condition (e.g., fixing temperature or carrying speed of the recording material passing through the fixing device) is changed in response to the settings. Recently, technologies for further using a sensor for discriminating the recording materials within the image forming apparatus to automatically discriminate the kinds of recording materials and variably controlling developing conditions, transfer conditions, or fixing conditions in response to the discriminated kinds are proposed.

In the technologies for automatically detecting the kinds of recording materials, for example, a method for detecting surface smoothness of the recording material by imaging the surface image of the recording material by a CCD sensor and converting the information into fractal dimensional information, a method for discriminating the kind of paper from surface smoothness by imaging the surface image of the recording material by a CCD sensor or CMOS area sensor and detecting roughness of the recording material from the magnitude relation of the light, or a method for detecting the thickness of the recording material from the length formed at the end of the recording material are proposed (e.g., see Japanese Patent Application Laid-open No. 2002-182518).

Furthermore, a technology for changing fixing conditions or the like by measuring the amount of light transmitted through the recording material and determining the material thickness of the recording material based on the magnitude of the amount of light is proposed (e.g., see Japanese Patent Application Laid-open No. 2003-186264).

However, in the above method for detecting surface smoothness of the recording material, sometimes the recording material can not be determined correctly when the recording material having the same smoothness but in different compressed conditions of paper fiber, for example, plain paper and heavy paper are determined. In such a case, developing conditions, transfer conditions, or fixing conditions can not be set suitably for the recording paper, and thereby, a problem that fixiability is deteriorated occurs.

On the other hand, in the above method for determining the material thickness of the recording material, the smoothness of the surface of the recording material is unknown, accordingly, since glossy paper or the like is less transparent than plain paper, the material thickness of the glossy paper is determined as being thicker even when the thickness thereof is the same as the plain paper, and thereby, suitable condition setting can not be performed.

Furthermore, in spite of the recent variety of kinds of recording materials, demands for printing quality are increased, and accurate determination of various recording materials is demanded.

The invention is achieved in light of these problems, and objected to provide a recording material discrimination device, an image forming apparatus, and a method for automatically discriminating various kinds of recording materials and performing image formation in suitable conditions.

SUMMARY OF THE INVENTION

In order to accomplish the object, a recording material discrimination device of the invention comprises a reflected light determination unit including an image reader for obtaining an image of a surface of a recording material by reading reflected light reflected from the surface of the recording material, and determining a first attribute of the recording material using the image of the surface of the recording material obtained by the image reader; a transmitted light determination unit for determining a second attribute of the recording material using transmitted light transmitted through the recording material; and a discrimination unit for discriminating a kind of the recording material based on the first attribute and the second attribute.

Further, a recording material discrimination method of the invention comprises a reflected light determination step for obtaining an image of a surface of a recording material by reading reflected light reflected from the surface of the recording material by an image reader, and determining a first attribute of the recording material using the obtained image of the surface of the recording material; a transmitted light determination step for determining a second attribute of the recording material using transmitted light transmitted through the recording material; and a discrimination step for discriminating a kind of the recording material based on the first attribute and the second attribute.

Furthermore, an image forming apparatus of the invention is, in an image forming apparatus comprising a latent image carrier for carrying a latent image, a developing part for visualizing the latent image as a developer image by providing a developer to the latent image carrier, a transfer part for transferring the developer image by the developing part onto a recording material carried in a predetermined direction, a fixing device for fixing the developer image to the recording material by heating and pressing the recording material onto which the developer image has been transferred by the transfer part in a predetermined fixing treatment condition, characterized by comprising: a reflected light determination unit including an image reader for obtaining an image of a surface of the recording material by reading reflected light reflected from the surface of the recording material, and determining a first attribute of the recording material using the image of the surface of the recording material obtained by the image reader before transfer by the transfer part; a transmitted light determination unit for determining a second attribute of the recording material using transmitted light transmitted through the recording material; and a control unit for discriminating a kind of the recording material based on the first attribute and the second attribute obtained before transfer by the transfer part and allowing the fixing device to fix the developer image to the recording material in the fixing treatment condition corresponding to the discriminated kind.

Further, an image forming apparatus of the invention is, in an image forming apparatus comprising a latent image carrier for carrying a latent image, a developing part for providing a developer to the latent image carrier, a transfer part for transferring the developer image onto a recording material, a fixing device for fixing the developer image to the recording material by heating and pressing, and a control unit for allowing the developing part to visualize the latent image as a developer image, allowing the transfer part to transfer the visualized image onto the recording material carried in a predetermined direction, allowing the fixing device to fix the transferred recording material in a predetermined fixing treatment condition, and discharging the fixed recording material, comprises: a first irradiating member for irradiating a recording material with predetermined light so as to obtain reflected light reflected from a surface of the recording material; a second irradiating member for irradiating the recording material with predetermined light so as to obtain transmitted light transmitted through the recording material; and a reader for receiving the reflected light or transmitted light from the recording material so as to read the light as an image and detect an amount of the light, wherein the control unit determines a kind of the recording material based on the image and the amount of the transmitted light by allowing the first irradiating member and the second irradiating member to irradiate the recording material with light, and allowing the reader to read the reflected light obtained by the first irradiating member as an image and detect the amount of transmitted light obtained by the second irradiating member before being transferred by the transfer part, and fixing the developer image to the recording material in the fixing treatment condition corresponding to the discriminated kind.

Furthermore, a recording material discrimination device of the invention comprises a reflected light determination unit for reading reflected light reflected from a surface of a recording material and determining a first attribute of the recording material; a transmitted light determination unit for reading transmitted light transmitted through the recording material and determining a second attribute of the recording material; and a discrimination unit for discriminating a kind of the recording material, wherein the discrimination unit determines whether to discriminate the kind of the recording material using the transmitted light determination unit and the reflected light determination unit or discriminate the kind of the recording material without using the transmitted light determination unit but using the reflected light determination unit according to a determination result of the transmitted light determination unit.

Further, a recording material discrimination method for controlling a recording material discrimination device including a reflected light determination unit for reading reflected light reflected from a surface of a recording material and determining a first attribute of the recording material; and a transmitted light determination unit for reading transmitted light transmitted through the recording material and determining a second attribute of the recording material comprises: a discrimination step for discriminating a kind of the recording material by the transmitted light determination unit; and a selecting step for selecting, a first discrimination method for discriminating the kind of the recording material using the transmitted light determination unit and the reflected light determination unit or a second discrimination method for discriminating the kind of the recording material without using the transmitted light determination unit but using the reflected light determination unit according to a determination result of the discrimination step.

Furthermore, an image forming apparatus of the invention is, in an image forming apparatus comprising a latent image carrier for carrying a latent image, a developing part for developing the latent image, a transfer part for transferring a developer image onto a recording material, and a fixing device for fixing the developer image, which has been transferred by the transfer part, to the recording material characterized by comprising: a reflected light determination unit for reading reflected light reflected from a surface of the recording material and determining a first attribute of the recording material before transfer by the transfer part; a transmitted light determination unit for reading transmitted light transmitted through the recording material and determining a second attribute of the recording material; and a discrimination unit for discriminating a kind of the recording material, wherein the discrimination unit determines whether to discriminate the kind of the recording material using the transmitted light determination unit and the reflected light determination unit or discriminate the kind of the recording material without using the transmitted light determination unit but using the reflected light determination unit according to a determination result of the transmitted light determination unit.

Further, a recording material discrimination device of the invention comprises a first irradiating member for irradiating a recording material with predetermined light so as to obtain reflected light reflected from a surface of the recording material; a second irradiating member for irradiating the recording material with predetermined light so as to obtain transmitted light transmitted through the recording material; a reader for reading the reflected light or transmitted light from the recording material; and a discrimination unit for discriminating a kind of the recording material based on a reading result of the reader by allowing the first irradiating member and the second irradiating member to irradiate the recording material with light, wherein the discrimination unit determines whether to discriminate the kind of the recording material using the transmitted light determination unit and the reflected light determination unit or discriminate the kind of the recording material without using the transmitted light determination unit but using the reflected light determination unit according to whether the recording material is a predetermined recording material or not.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
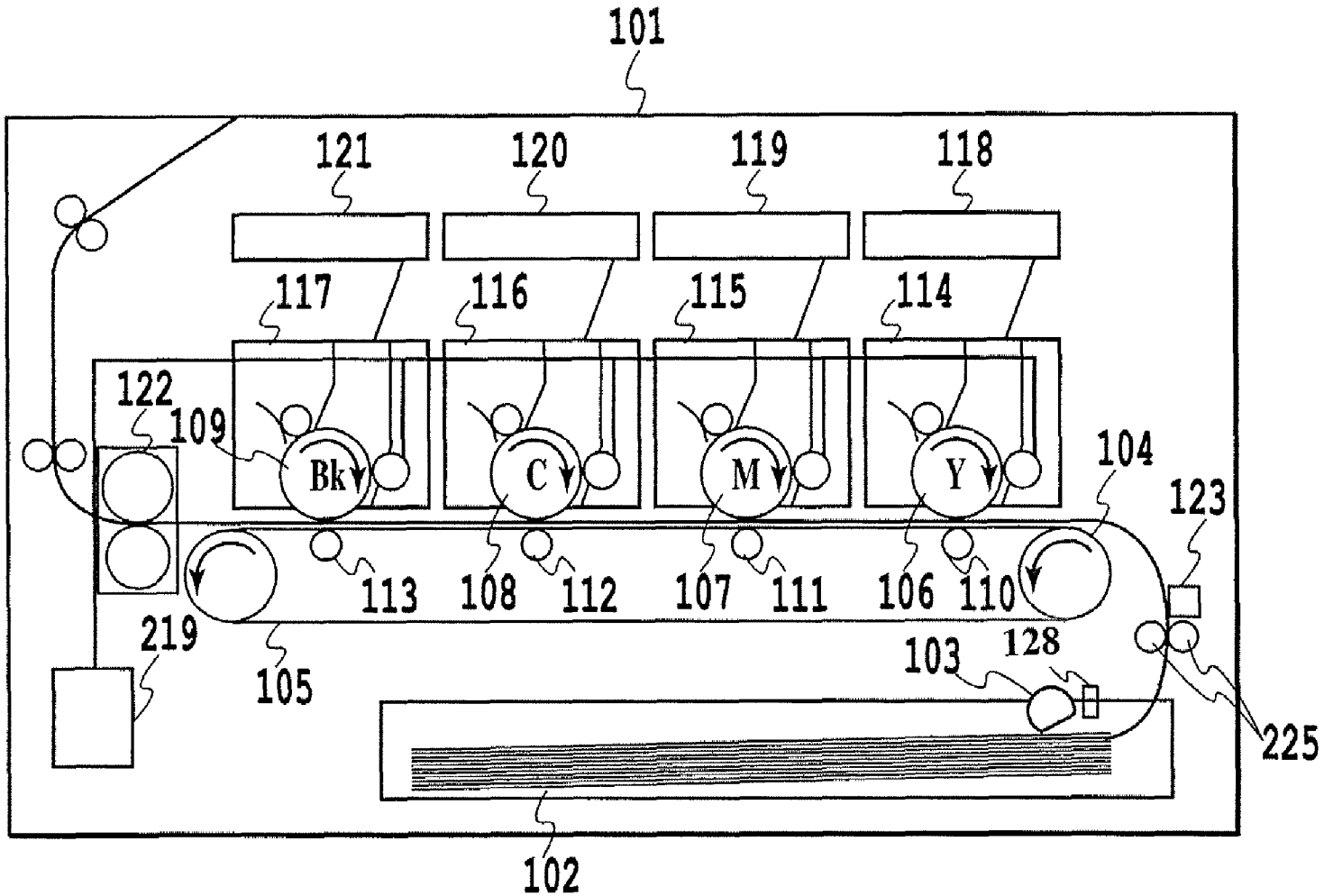
FIG. 1 is a schematic diagram showing an image forming apparatus used in one embodiment of the invention.

A recording material discrimination device and a method therefor are used in a general image forming apparatus as shown in FIG. 1. In FIG. 1, the image forming apparatus 101 includes a paper cassette 102, a paper feed roller 103, a transfer belt drive roller 104, a transfer belt 105, respective photoconductor drums 106 to 109 of yellow, magenta, cyan, and black, respective transfer rollers 110 to 113 for the respective colors, respective cartridges 114 to 117 of yellow, magenta, cyan, and black, optical units 118 to 121 of yellow, magenta, cyan, and black, a fixing unit 122, a paper presence sensor 118 for detecting presence or absence of paper within the paper cassette, and a carrying roller 225 for carrying paper.

The image forming apparatus 101 generally transfers images of yellow, magenta, cyan, and black in a superposed condition onto a recording material using the electrophotographic process, and thermally fixes the transferred toner images by thermally controlling them with the fixing unit 122 including a fixing roller, but not limited to that. Further, the optical units 118 to 121 of the respective colors are arranged so as to scan the surfaces of the respective photoconductor drums 106 to 109 while exposing them to light with laser beams to form latent images, and the series of image forming operation is synthesized so that the images may be transferred onto the carried recording material from a predetermined position.

Furthermore, the image forming apparatus 101 includes a paper feed motor for feeding and carrying recording paper as a recording material, and a desired image is formed on the surface of the fed recording paper while the recording paper is being carried from the transfer belt 104 to the fixing unit 122.

An image reading sensor 123 includes, though described later, a CMOS area sensor, a reflective LED, etc., and is disposed forward of the transfer belt to which the recording paper is carried. The surface of the recording paper that has been carried is irradiated with light and the reflected light is collected to form an image. Then, by the CMOS area sensor, an image in a specified area on the surface of the recording material is read out.

Figure 2:
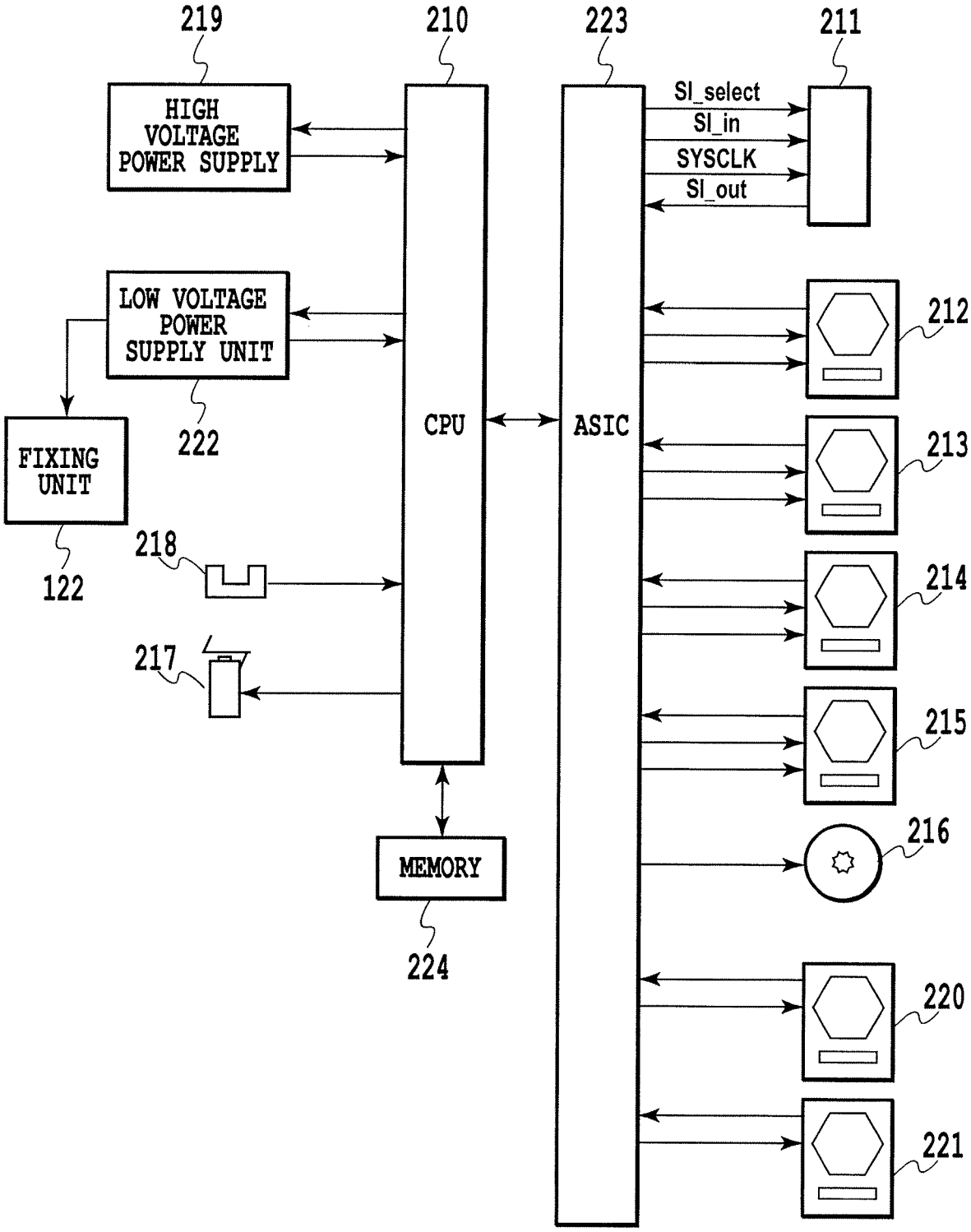
FIG. 2 shows the constitution of the respective units controlled by the control CPU according to one embodiment of the invention.

As below, referring to FIG. 2, a control CPU 210 as a controller of the image forming apparatus 101 generates a desired amount of heat by supplying a predetermined power via a low voltage power supply 222 to the fixing unit 122 and supplies the heat to the recording material so as to melt and fix the toner image on the recording material.

Next, referring to FIG. 2, the operation of the control CPU of the one embodiment of the image forming apparatus using the recording material discrimination device and the method therefor of the invention will be described. FIG. 2 shows the constitution of the respective units controlled by the control CPU 210. In FIG. 2, the CPU 210 is connected to a CMOS area sensor 211, and optical units 212 to 215 for each color including a polygon mirror, a motor, a laser emitting element, or the like via an ASIC 223. In order to depict a desired latent image by scanning the photoconductor drum surfaces with lasers, the CPU controls the optical units by outputting control signals to the ASIC. Similarly, the CPU 210 controls a paper feed motor 216 for driving the paper feed roller 103 and the carrying roller 225 so as to carry the recording material, a paper feed solenoid 217 switched on at the start of driving of the paper feed roller for feeding the recording paper for driving the paper feed roller 103, a paper presence sensor 218 for detecting whether or not the cassette 102 for holding recording materials is set in a predetermined position, a high voltage power supply 219 for controlling primary charging, developing, primary transfer, secondary transfer biases necessary for the electrophotography process, a drum drive motor 220 for the photoconductor drums and transfer rollers, a belt drive motor 221 for driving the transfer belt and the roller of the fixing unit, and the fixing unit 122 and the low voltage power supply unit 222. Furthermore, the control CPU 210 monitors the temperature with a thermistor (not shown) provided in the fixing unit 122 so as to control the fixing temperature to be constant.

Further, the control CPU 210 is connected to a memory 224 via a bus or the like (not shown), and, in the memory 224, programs and data for executing the above described control and a whole or part of the processing performed by the control CPU 210 in the respective embodiments to be described in the specification is stored. That is, the control CPU 210 executes the operation of the respective embodiments of the invention using the programs and data stored in the memory 224.

The ASIC 223 controls speeds of the motors within the CMOS area sensor 211 and the optical units 212 to 215 and the paper feed motor based on the instructions of the control CPU 210. The speed control of the motor is performed by detecting a tack signal (a pulse signal output from the motor at each time when the motor is rotated) and outputting an acceleration signal or a deceleration signal to the motor so that the intervals of the tack signals may be predetermined times. Thus, it is more advantageous that a control circuit is configured by a circuit of the hardware of the ASIC 223, because the control load on the CPU 212 can be reduced.

When the control CPU 210 receives a print command instructed from a host computer (not shown), the CPU determines the presence or absence of a recording material with the paper presence sensor 218. If there is the recording material, the CPU drives the paper feed motor 216, the drum drive motor 220, and the belt drive motor 221, and drives the paper feed solenoid 217 so as to carry the recording material to a predetermined position.

When the recording material is carried to the position of the image reading sensor 123 including the CMOS area sensor 211, the control CPU controls the paper feed motor 216 etc. to stop the recording material temporarily. Then, the control CPU 210 outputs an instruction signal for allowing the CMOS area sensor 211 to perform imaging to the ASIC 223. The CMOS area sensor 211 performs imaging on the surface image of the recording material based on the signal instruction. At this time, the ASIC 223 activates Sl_select, and then, outputs SYSCLK with a predetermined pulse at predetermined timing and retrieves imaging data output from the CMOS area sensor 211 via Sl_out.

On the other hand, regarding the gain setting of the CMOS area sensor 211, the ASIC 223 activates Sl_select by setting a value that the control CPU 210 has determined in advance in the register within the ASIC 223, and then, outputs SYSCLK with a predetermined pulse at predetermined timing and sets the gain with respect to the CMOS area sensor 211 via Sl_in.

The ASIC 223 has a circuit 702 for realizing the recording material discrimination device and the method therefor of the invention, which will be described as below, and the operation results of the operation, which will be described later, for discrimination of the attributes of the recording material are stored in Register A and Register B within the control circuit 702. Then, the CPU 210 reads the operation results that have been stored in Register A and Register B within the control circuit 702, discriminates the kind of the fed recording material, and controls to change image formation conditions in response to the results. When the discrimination of the kind of the recording material ends, the carriage of the recording material, which has been stopped temporarily, is restarted, and image formation is started.

The control of various kinds of image formation conditions executed by the CPU 210 is as follows.

For example, in the case where the kind of the recording paper is glossy paper having higher glossiness than plain paper, the CPU 210 controls to make the developing bias higher than in the case of plain paper (make the potential difference relative to the surface potential of the photoconductor drum larger), increase the amount of toner deposited on the surface of the recording paper, and increase the glossiness of the image on the recording paper. This is because it is desired that the glossiness of the image on the recording paper is made higher in the case of printing using glossy paper. Note that the developing bias (voltage) refers to a voltage applied to the developing roller from the high voltage power supply 219 based on the instruction of the CPU 210 as shown in FIG. 1.

Further, the CPU 210 controls to change the fixing temperature of the fixing unit 222 (the target temperature that the heater (not shown) within the fixing unit 222 should maintain) in response to the kind of the fed recording material. In the case of heavy paper thicker than plain paper, there is a problem that the fixability is deteriorated when trying to fix a toner image onto heavy paper at the same fixing temperature as for the plain paper because the heavy paper has larger heat capacity than the plain paper. Accordingly, when the CPU 210 discriminates that the recording paper is heavy paper, the CPU controls to make the fixing temperature higher than the fixing temperature for plain paper so as to improve the toner fixability to the heavy paper.

Furthermore, the CPU 210 controls to discriminate the kind of the fed recording material so as to change the carrying speed of the recording material according to the result. The control of the carrying speed is realized by resetting the speed control register value of the ASIC 223, which actually controls the speed, by the CPU 210. Specifically, in the case where the kind of the recording paper is heavy paper thicker than plain paper, there is a problem that the fixability is deteriorated when trying to fix a toner image onto heavy paper at the same carrying speed as for the plain paper because the heavy paper has larger heat capacity than the plain paper. Accordingly, when the CPU 210 discriminates that the recording paper is heavy paper, the CPU controls to make the carrying speed of the recording material lower than the carrying speed at which plain paper passes through so as to increase the heat amount supplied to the heavy paper per unit time.

Alternatively, fixing temperature conditions are varied according to recording materials having different basic weights, for example, it is possible that, for a relatively thick recording material, the fixing temperature is set at a higher level because the material has larger heat capacity, and, on the other hand, for a relatively thin recording material, i.e., the recording material having smaller heat capacity, fixing temperature may be set at a lower level. Or, the recording material carrying speed can be controlled to be varied depending on the basic weights of the recording materials.

In addition, in the case of an OHT or glossy paper, the fixing temperature may be set higher by the discrimination of them, the fixability of toner deposited on the surface of the recording material is raised, and glossiness is made higher, so that the image quality can be improved.

Thus, in the embodiment, operation is performed by the hard circuit of the ASIC from the surface image of the recording material imaged by the CMOS area sensor, and the CPU controls to change the developing bias conditions of the high voltage power supply, the fixing temperature of the fixing unit, or the carrying speed of the recording material from the result.

First Embodiment

Figure 3:
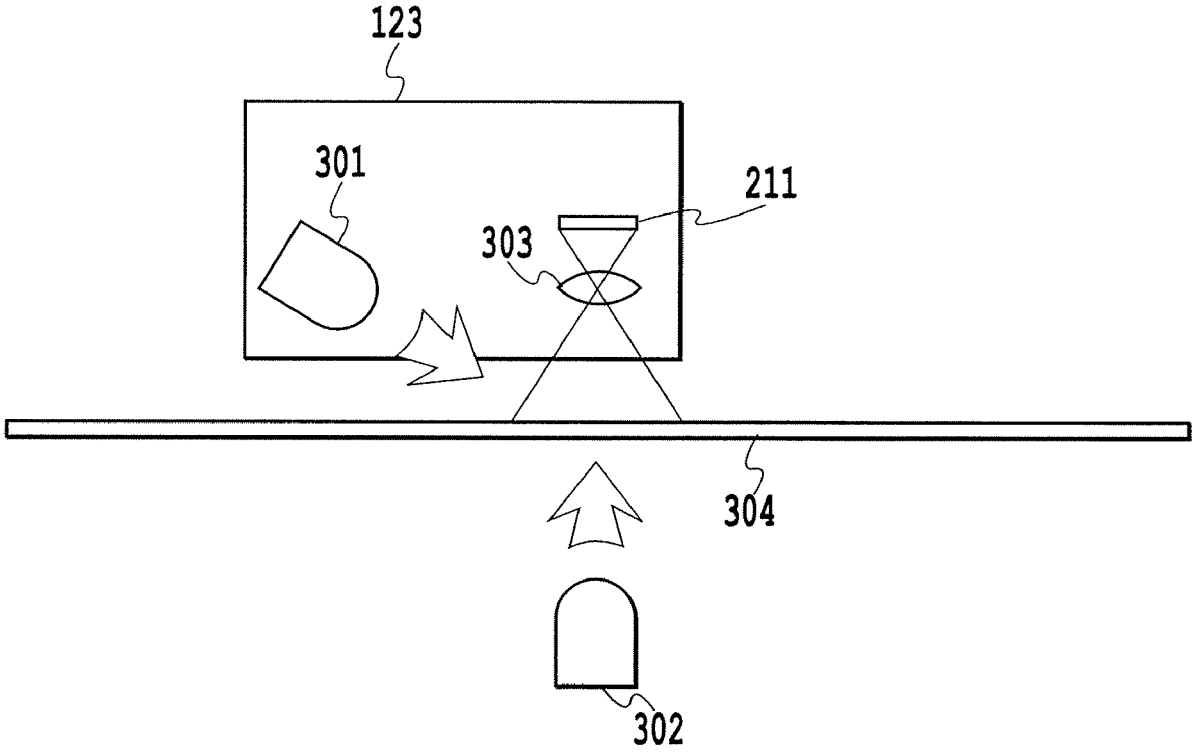
FIG. 3 is a schematic view showing general constitution for detecting surface smoothness, the amount of reflected light, and the amount of transmitted light of a recording material.

Next, a recording material discrimination device according to one embodiment of the invention of the application will be described. FIG. 3 is a schematic view showing the general constitution for detecting the surface smoothness, the reflected amount of light and the transmitted amount of light of the recording material, and illustrates the invention best.

The image reading sensor 123 includes a reflective LED 301, a transmissive LED 302 disposed on the opposite side relative to a recording material 304 for detecting the transmitted amount of light, the CMOS area sensor 211, and an imaging lens 303. By the way, here, not only the CMOS area sensor, but also a CCD sensor can be used as the sensor 211.

The light from the reflective LED 301 as a light source is applied toward the surface of the recording material 304. Although the LED is used as the light source in the embodiment, for example, a xenon tube, halogen lamp or the like can be used. The reflected light from the recording material 304 is collected via the lens 303 and an image is formed on the CMOS area sensor 211. Thereby, the image of the surface of the recording material 304 can be read.

In the embodiment, the LED 301 is disposed so as to apply LED light to the surface of the recording material 304 diagonally at a predetermined angle as shown in FIG. 3.

(Discrimination of Kind of Recording Material)

Figure 4:
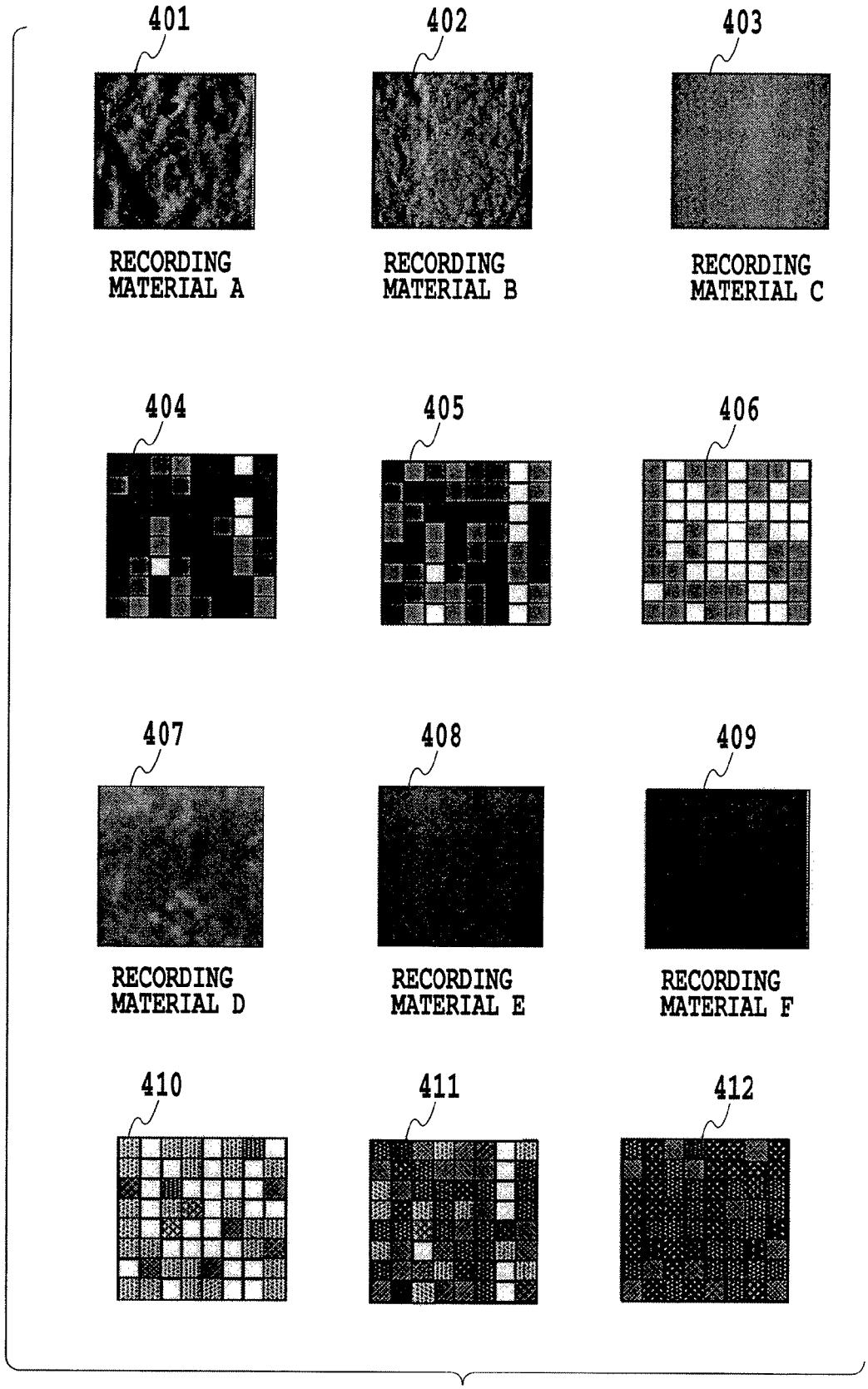
FIG. 4 shows the comparison between analog images on the surface of the recording materials read by the image reading sensor and digital images formed by digitizing the analog output into 8×8 pixels.

FIG. 4 shows the comparison between analog images on the surface of the recording materials 304 read by the CMOS area sensor 211 of the image reading sensor 123 and digital images formed by digitizing the output from the CMOS area sensor 211 into 8×8 pixels. Here, the digitization is performed by converting the analog output from the CMOS area sensor 211 into 8×8 pixel data by A/D conversion.

In FIG. 4, a recording material A401 is so-called rough paper with a surface having relatively rough paper fiber, a recording material B402 is so-called plain paper that is generally used, a recording material C403 is glossy paper with sufficiently compressed paper fiber, and they are shown in enlarged surface images thereof, respectively. These images 401 to 403 that have been read in the CMOS area sensor 211 are digitized into images 404 to 406 shown in FIG. 4. Thus, the images of the surfaces are different depending on the kinds of recording materials. This is a phenomenon that occurs mainly because the conditions of the fiber on the surface of paper are different.

Aside from this, the amount of reflected light of the recording material is generally calculated from a total or an average of light input in the respective pixels, however, in another example, only a result of one light receiving pixel can be used instead.

As described above, by the image obtained by digitizing the image as a result of reading the surface of the recording material with the CMOS area sensor 211, the surface condition of the paper fiber of the recording material can be identified, and, by calculating the amount of reflected light additionally, more accurate discrimination of the recording material can be achieved.

In order to identify the surface of the recording material, a part of the surface of recording material is read as an image of 8×8 pixels. Subsequently, with respect to one line in a direction perpendicular to the carrying direction of the recording material in the image, density Dmax of a pixel having the maximum density and density Dmin of a pixel having the minimum density are detected, and Dmax−Dmin is averaged with respect to each line. Then, by the value of Dmax−Dmin obtained by averaging, the quality of material (smoothness) as an attribute of the recording material can be determined.

That is, in the case where paper fiber on the surface is rough like the recording material A, the fiber casts many shadows, and thus, the difference between the light point and the dark point becomes larger and Dmax−Dmin becomes larger. On the other hand, as for the image of the surface of the recording material on which fiber is sufficiently compressed and having high smoothness like the recording material C, the fiber casts few shadows and Dmax×Dmin becomes smaller. By the comparison, the quality of material is determined and forms a part of information for discriminating the kind thereof.

Similarly, in FIG. 4, the image 407 is an enlarged surface image of recording paper D as thin paper in an area applied with light that has been emitted from the transmissive LED 302 and transmitted through the recording material, the image 408 is an enlarged surface image of recording paper E as so-called plane paper that is generally used in an area applied with light by the transmissive LED 302, and the image 409 is an enlarged surface image of recording paper F as heavy paper in an area applied with light by the transmissive LED 302. These images 407 to 409 that have been read in the CCD sensor 211 are digitized into images 410 to 412 in FIG. 4.

Thus, depending on the kind of recording paper, the amount of transmitted light and the image thereof varies. This is a phenomenon that occurs mainly because the conditions of the fiber on the surface of the paper and compressed conditions of the paper fiber are different.

Since the above described control processor is needed to perform sampling processing of images from the CMOS area sensor 211 and gain and filter operation processing in real time, a digital signal processor is desirably used as the processor.

Next, a method of measuring transmittance of the recording material 304 will be described. The light from the transmissive LED 302 as a light source is applied from the opposite side of the image reading sensor 123 toward the recording material 304 so as to enter the reading area of the image reading sensor 123 on the recording material.

Figure 5:
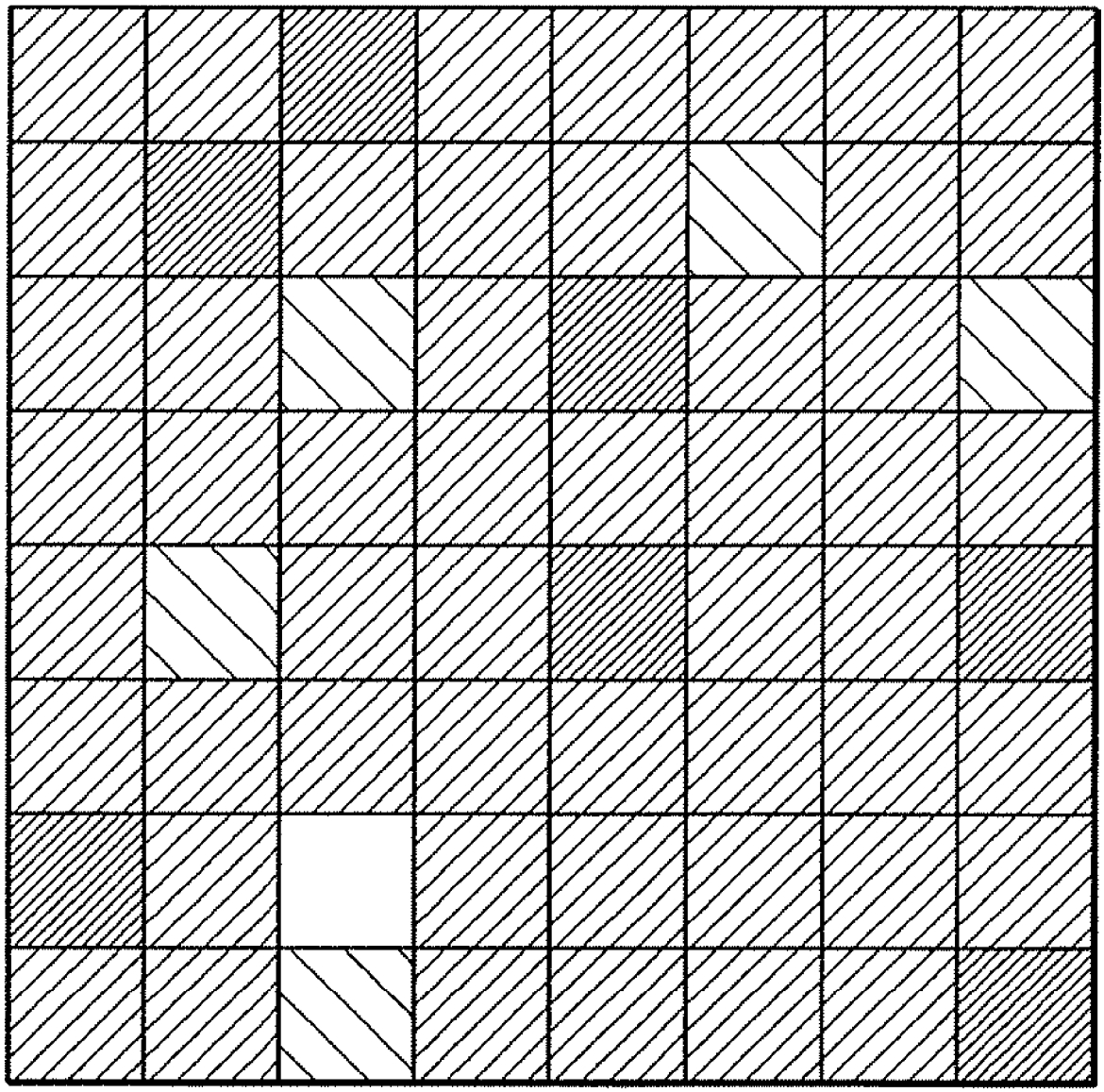
FIG. 5 shows the image of the recording material read by the image reading sensor by digitizing the image into 8×8 pixels using the transmissive LED.

FIG. 5 shows the surface of the recording material 304 read by the CMOS area sensor 211 of the image reading sensor 123 by digitizing the output from the CMOS area sensor 211 into 8×8 pixels. The transmitted light from the recording material 304 is collected via the lens 303 and enters the CMOS area sensor 211. Normally, a total value or an average value of the amount of light input to the respective pixels in the entire area or a predetermined area of the sensor is used as the amount of reflected light, however, only a result of one light receiving pixel can be used.

Figure 6:
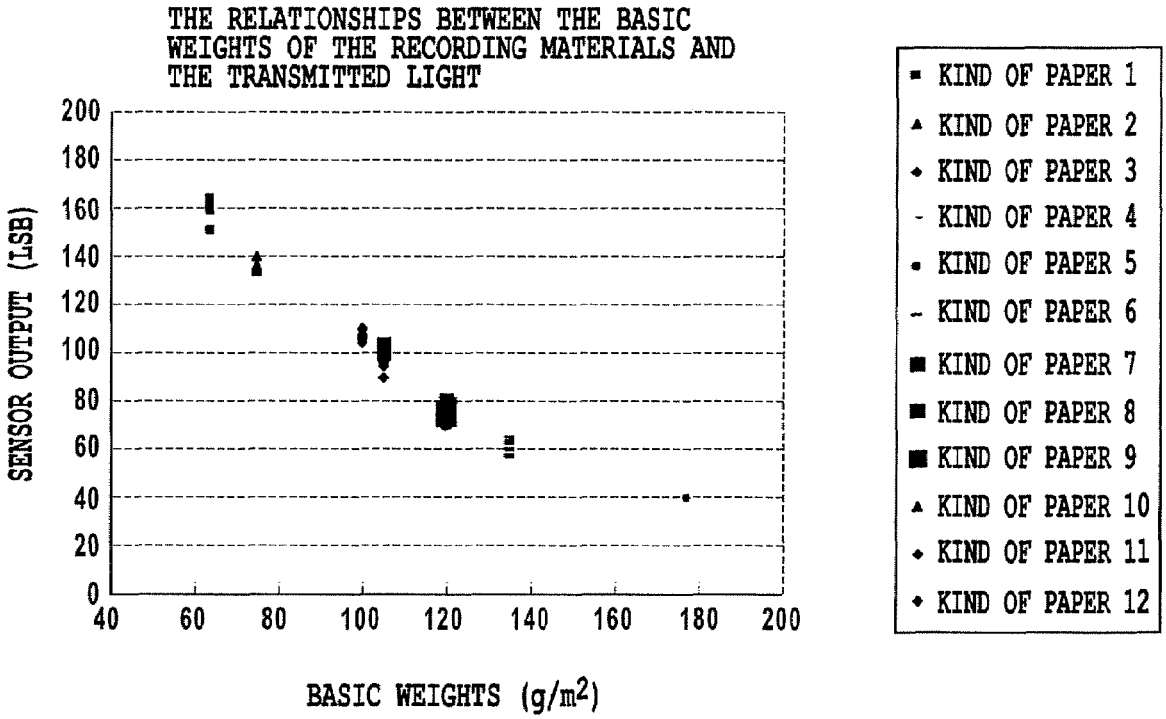
FIG. 6 shows the relationships between the basic weights of the recording materials and the transmitted light.

FIG. 6 shows the relationships between the basic weights of the recording materials and the transmitted light. For example, in the case of the recording material having a heavy basic weight like heavy paper, the amount of transmitted light is small, while, in the case of the recording material having a low basic weight like thin paper, the amount of transmitted light is large. According to the characteristics, the material thickness as one of attributes of the recording material is determined based on the amount of transmitted light and use it as one piece of information for discriminating the kind of recording material.

The kinds of recording materials envisioned in the embodiment are as follows, and the kind is discriminated by the surface condition and material thickness as described below. Note that the basic weight mentioned as below refers to a weight per unit area of a recording material.

(1) Thin paper (basic weight (weight per unit area): 64 g/m$^2$ or less)
(2) Plain paper (basic weight: 65 to 105 g/m$^2$)
(3) Heavy paper 1 (basic weight: 106 to 135 g/m$^2$)
(4) Heavy paper 2 (basic weight: 136 g/m$^2$ or more)
(5) Glossy paper
(6) Glossy film
(7) OHT What is determined by the amount of reflected light from the recording material is one of two sets of (1) to (6) and (7) because (7) is transparent and having high transmittance of light.

What is determined by the ratio between dark and light in the image obtained from the reflected light of the recording material is one of three sets of (1) to (4), (5), and (6). Here, in the embodiment, when the ratio between dark and light is detected for the determination, normalization is performed with the amount of reflected light. That is, since the value Dmax−Dmin varies if there are differences in amounts of light of entire two-dimensional images, normalization is performed so that average values of entire two-dimensional images may be equal.

What is determined by the amount of transmitted light is one of four kinds of (1), (2), (3), and (4). The amount of received light of the transmitted light in the case where a constant amount of light is applied from the back side of the paper becomes (1)>(2)>(3)>(4) because the basic weights of (1) to (4) are different from each other. Here, in the embodiment, determination is performed using the average value of the amount of transmitted light of all pixels formed in 8×8 pixels.

By combining the above described determinations, various recording materials of (1) to (7) can be discriminated accurately.

(Implementation of Recording Material Discrimination Function)

Figure 7:
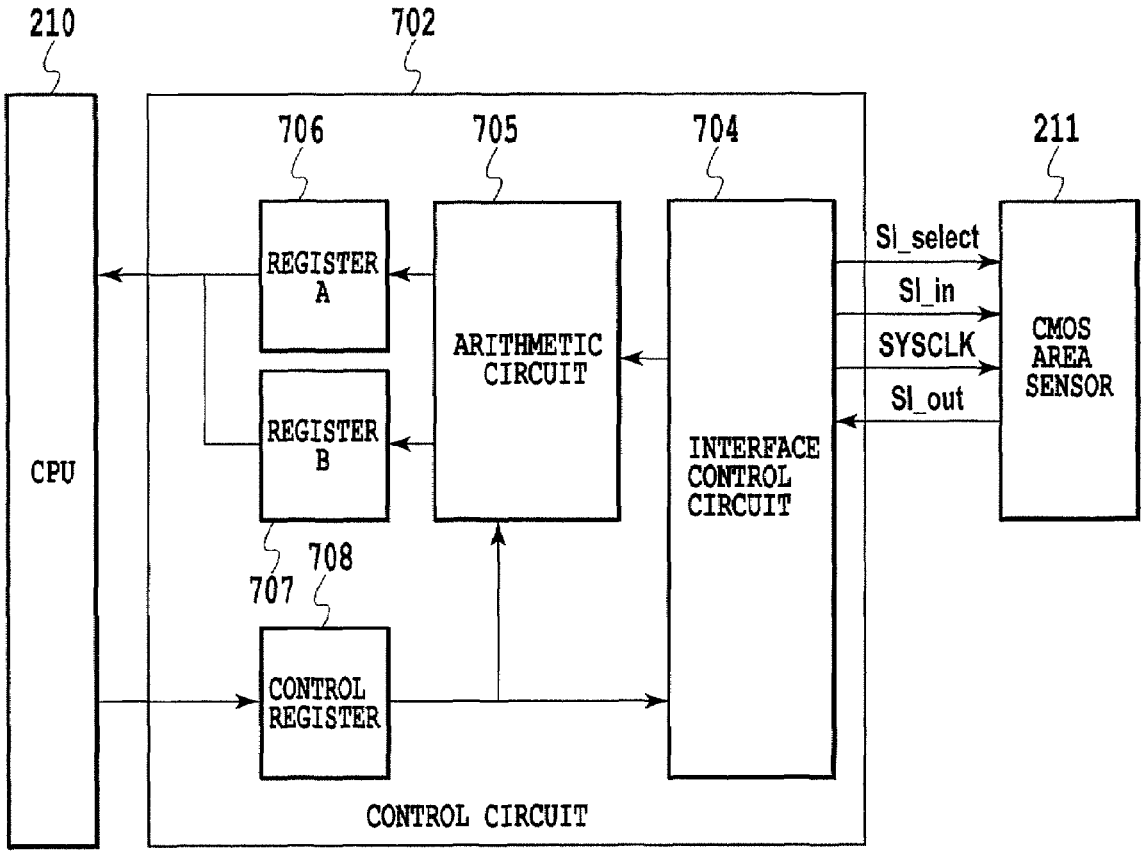
FIG. 7 is a block diagram showing the control circuit of the CMOS area sensor according to one embodiment of the invention.

The control circuit of the CMOS area sensor 211 for performing the above described operation will be described by referring to FIG. 7. FIG. 7 is a block diagram showing the control circuit of the CMOS area sensor 211. In FIG. 7, the CPU 210 as a judging part includes a control circuit 702, the CMOS area sensor 211, an interface control circuit 704, an arithmetic circuit 705, a register A706, a register B707, and a control register 708.

Next, the operation thereof will be described. When the CPU 210 provides an operation instruction of the CMOS area sensor 211 to the control register 708, imaging of the image of the surface of the recording material is started by the CMOS area sensor 211. That is, by activating Sl_select, storage of charge in the CMOS area sensor 211 is started. When the CMOS area sensor 211 is selected from the interface circuit 704 via Sl_select and SYSCLK is generated at predetermined timing, the imaged digital image data is transmitted from the CMOS area sensor 211 via the Sl_out signal.

Operation is executed on the imaging data received via the interface circuit 704 in the control circuit 702, and the operation results are stored in the register A706 and the register B707. The CPU 210 determines the attribute of the recording material from the two register values.

Note that the value to be stored in the register A706 is a value obtained by averaging Dmax−Dmin of eight lines with respect to a part of the surface of the recording material that the CMOS area sensor 211 has acquired as an image, and during acquisition of the image, the LED 301 irradiates the front surface of the recording material. Further, the value to be stored in the register B707 is a value obtained by averaging amounts of light at the respective pixels of 8×8 pixels with respect to a part of the surface of the recording material that the CMOS area sensor 211 has acquired as an image, and during acquisition of the image, the transmissive LED 302 irradiates the rear surface of the recording material.

Figure 8:
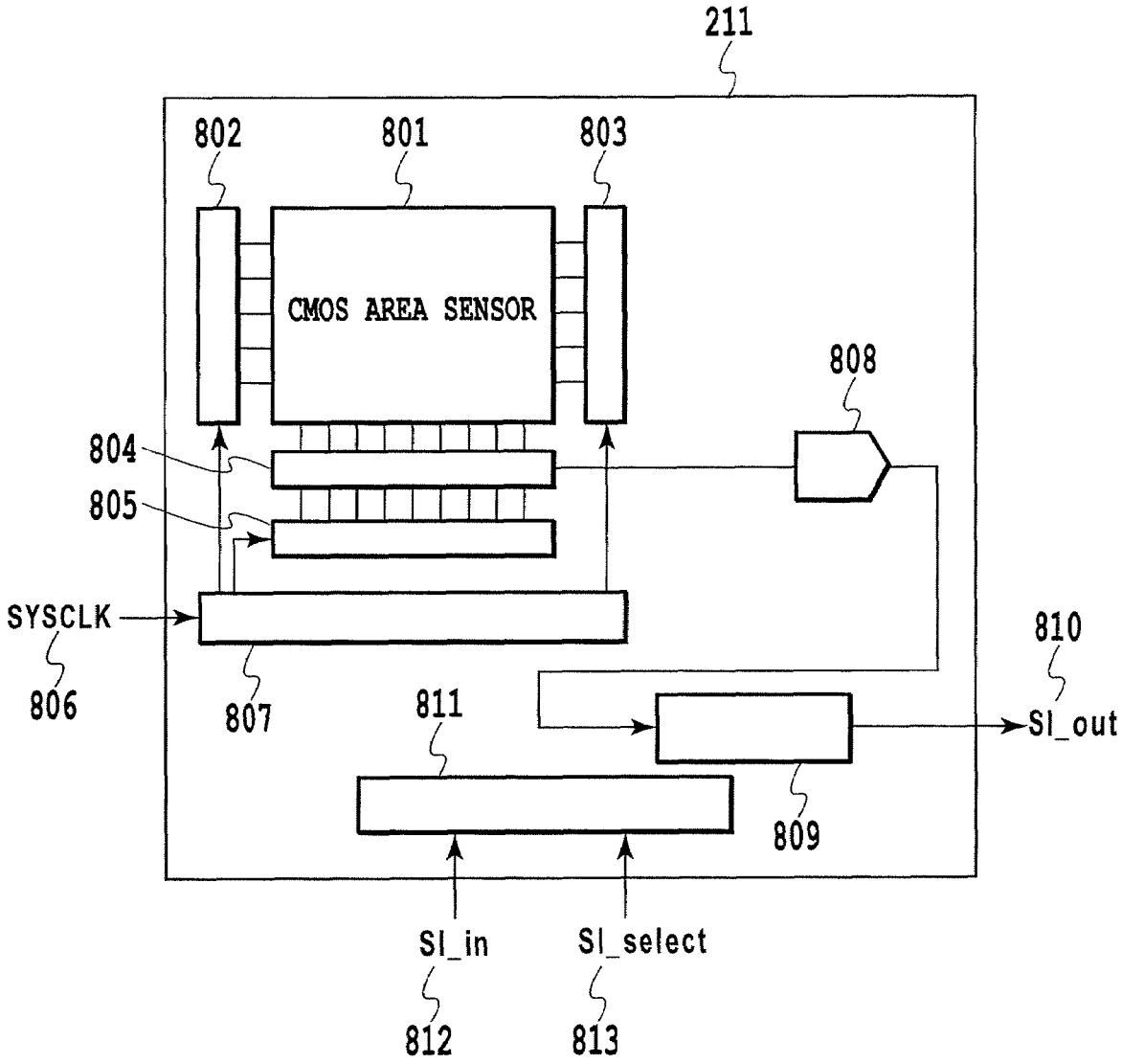
FIG. 8 shows the circuit block diagram of the CMOS area sensor according to one embodiment of the invention.

Next, a sensor circuit block diagram will be described using FIG. 8. FIG. 8 shows the circuit block diagram of the CMOS area sensor 211. In FIG. 8, the CMOS area sensor 211 has a CMOS area sensor part 801, and, for example, a sensor of 8×8 pixels is disposed in an area. The CMOS area sensor 211 further has vertical shift registers 802 and 803, an output buffer 804, a horizontal shift register 805, a system clock 806, and a timing generator 807.

Next, the operation thereof will be described. When the Sl_select signal 813 is activated, the CMOS area sensor part 801 starts to store charge based on the received light. Then, when the system clock 806 is provided, pixel lines to be read out are sequentially selected in the vertical shift registers 802 and 803, and data are sequentially stored in the output buffer 804.

The data stored in the output buffer 804 is transferred to an A/D converter 808 by the horizontal shift register 805. The pixel data digitally converted by the A/D converter 808 is controlled at predetermined timing by an output interface circuit 809 and output to the Sl_out signal 810 in the period in which the Sl_select signal 813 is active.

On the other hand, a control circuit 811 can control so as to change the A/D conversion gain of the Sl_in signal 812. For example, in the case where the contrast of the imaged image can hardly be obtained, the CPU can change the gain so as to perform imaging at best contrast.

Thus, using two irradiating means of the reflective LED 301 and the transmissive LED 302, surface conditions, reflectances, transmittances of various recording materials can be detected and discrimination of the kinds of recording materials can be achieved.

FIRST EXAMPLE

Using FIG. 9, a control flow by the control processor for executing fixing treatment condition control provided in the image forming apparatus 101 according to the first example will be described. First, the reflective LED 301 is turned on (S901) and the CMOS area sensor 211 reads the image of the recording paper (S902). The image reading while turning on the reflective LED 301 is performed in plural times, and images are read at plural points on the recording paper. This operation is shading operation for obtaining correction data for correcting noise such as irregularities in the amount of light of the LED based on the images read in plural times. After the shading operation is executed, operation for reading the image is performed again.

After the reflective LED 301 is turned off (S903), constants for gain operation for gain adjustment and filter operation are adjusted (S904). The gain operation and filter operation are programmably processed by the control processor. For example, the gain operation is performed by adjusting the gain of the analog output from the CMOS area sensor 211. This gain adjustment operation is performed by selecting a preset value. That is, in the case where the amount of reflected light reflected from the surface of the recording material is larger, or too small on the contrary, because the image of the surface of the recording material can not be read effectively and the change in the image can not be derived, the gain of the analog output is adjusted to adjust the amount of light so as to be an appropriate value. Further, the filter operation is executed using the correction data obtained in the above described shading operation. It is performed, when the analog output from the CMOS area sensor 211 is A/D converted into digital data of 8 bits and 256 levels of gray, by subtracting the value of the correction data obtained by the shading operation from the digital data. Thus, the noise components (components of the irregularities in the amount of light of the LED or the like) of the output from the CMOS area sensor 211 are removed.

Whether sufficient image information for performing the next image comparison operation is obtained or not is determined (S905), if determined that the sufficient image information is obtained, the image comparison operation as below is performed (S906), and the kind of paper is determined based on the result of the image comparison operation (S907). Whether sufficient image information is obtained or not is determined by having set a threshold value of the image information within a memory 224 in advance, and comparing the obtained image information and the value, for example.

Next, a method of the above described image comparison operation will be described. In the image comparison operation, the image of the surface of the recording material is read, the density value Dmax of the pixel at the maximum density and the density value Dmin of the pixel at the minimum density are detected with respect to one line perpendicular to the carrying direction of the recording material in the image, and Dmax−Dmin is averaged with respect to each line. That is, in the case where paper fiber on the surface is rough like the recording paper A, the fiber casts many shadows. As a result, the difference between the light point and the dark point becomes larger, and thereby, Dmax−Dmin become larger. On the other hand, on the surface of the recording material having high smoothness like the recording paper C, the fiber casts few shadows and Dmax−Dmin becomes smaller.

Thus, the kind of recording material is determined by computing Dmax−Dmin and comparing the result with the reference values that have been stored in a memory (not shown) such as an EEPROM. By the way, the reference values referred to here are values for discriminating the kind of recording material as being a glossy film, gloss paper, or paper having low smoothness such as plain paper (plain paper, heavy paper 1, heavy paper 2, or thin paper). The kind is determined as below based on the reference values R1 to R3 (R1<R2<R3).

(A) Dmax−Dmin≦R1 . . . determined as being a glossy film (B) R1<Dmax−Dmin≦R2 . . . determined as being glossy paper (C) R2<Dmax−Dmin≦R3 . . . determined as being plain paper or the like (plain paper, heavy paper 1, heavy paper 2, or thin paper)

As a result of the above described image comparison operation, if the material is determined as being a glossy film or glossy paper, because there is no need to determine the thickness of the recording material by the amount of transmitted light, the transmissive LED 302 is not needed to be turned on, and the fixing temperature in response to the kind of paper is set (S908).

However, if the material is determined as being plain paper (plain paper, heavy paper 1, heavy paper 2, or thin paper), thin paper, plain paper, or heavy paper can not be determined accurately only by the smoothness of the paper (fiber condition on the surface of the recording material). Accordingly, in order to check the thickness of the recording material from the compressed condition of the paper fiber, the transmissive LED 302 is turned on (S909), the CMOS area sensor 211 reads the surface image within the area applied with light by the transmissive LED 302 (S910), and an average value of all pixels is computed. That is, in the case where the fiber is slightly compressed like the recording paper D, because the average value of the amount of the transmitted light becomes higher, and, in the case where the fiber is highly compressed like the recording paper F, because the average value of the amount of the transmitted light becomes lower, the determination of the transmission characteristics can be performed by comparison between the respective average values.

After the transmissive LED 302 is turned off (S911), the average value is compared with the reference values that have been stored in advance in the memory such as an EEPROM (S912), and thin paper, plain paper, heavy paper 1, or heavy paper 2 is determined based on the result. Here, the kind is determined as below based on the reference values R4 to R6 (R4<R5<R6).

(D) average value of all pixels≦R4 . . . determined as being heavy paper 2

(E) R4<average value of all pixels≦R5 . . . determined as being heavy paper 1

(F) R5<average value of all pixels≦R6 . . . determined as being plain paper (G) R6<average value of all pixels . . . determined as being thin paper Note that, since the above described control processor is needed to perform sampling processing of images from the CMOS area sensor 211 and gain and filter operation processing in real time, a digital signal processor is desirably used as the processor.

As described above, according to the example, first, the condition of the paper fiber on the surface of the recording paper is detected, then, the amount of transmitted light from the recording paper is detected, and the kind of recording material can be discriminated from the detection result. Further, after the kind of recording material is discriminated, a predetermined temperature control condition of the fixing unit 122 in response to the recording material is read and an optimum condition of fixing temperature in response to the condition (roughness) of the surface of the recording paper and compressed condition of paper fiber is set, and thereby, good fixed image can be obtained.

SECOND EXAMPLE

Figure 10:
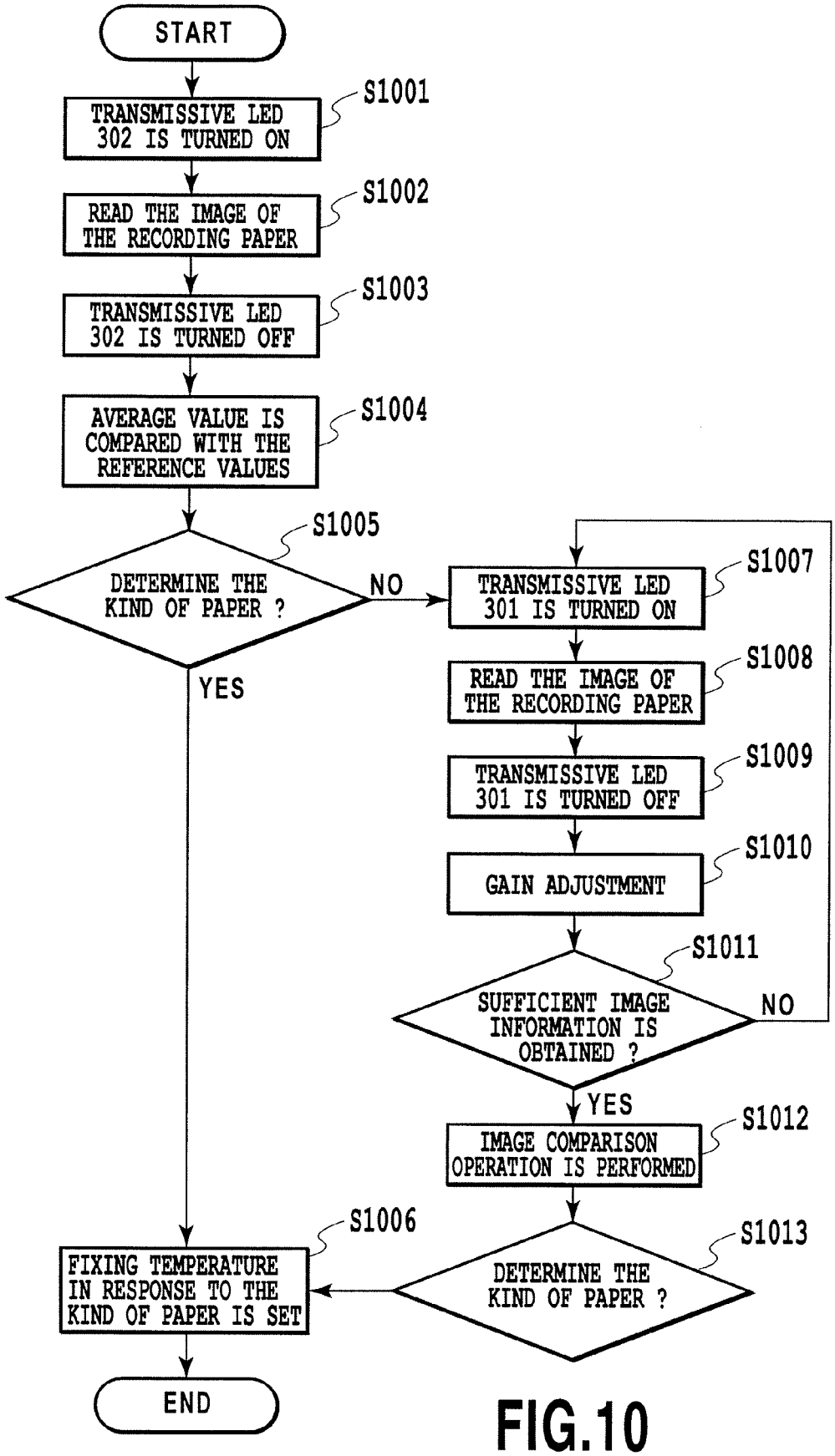
FIG. 10 is a flowchart showing a control flow by the control processor for executing fixing treatment condition control provided in the image forming apparatus according to the second example.

Next, the second example of the invention will be described. Note that the same components as in the first example are assigned with the same signs and the description thereof will be omitted. FIG. 10 is a flowchart for explaining the control in the example. As well as in the first embodiment, the LED 302 is turned on (S1001), the CMOS area sensor 211 reads the surface image within the area applied with light by the transmissive LED 302 (S1002), and an average value of amounts of received light of all pixels is calculated by performing operation.

After the LED 302 is turned off (S1003), the average value is compared with the reference values that have been stored in advance in the memory such as an EEPROM (S1004), and thin paper, plain paper, or heavy paper is determined based on the result (S1005). If the paper is determined as being thin paper or plain paper from the determination result, because there is no need for determination by the image of the reflected light, the fixing temperature in response to the kind of paper is set (S1006).

On the other hand, if the paper is determined as being heavy paper, the LED 301 is turned on and the surface image of the recording paper is imaged and read (S1007). Whether the paper is glossy paper or heavy paper is determined by comparing the value with the reference values that have been stored in the memory such as an EEPROM based on the imaged image (S1013). By the way, the description of the processes in S1008 to S1012 will be omitted because they are the same as in S902 to S905 in FIG. 9 in the first example.

As described above, according to the embodiment, even when the determination processing is executed in the different order from that in the first example (that is, first, the amount of transmitted light from the recording paper is detected, and then, the condition of paper fiber on the surface of the recording paper is detected), the kind of recoding paper can be discriminated similarly. Further, an optimum condition of fixing temperature in response to the condition (roughness) of the surface of the recording paper and compressed condition of paper fiber is set as well as in the first embodiment, and thereby, good fixed image can be obtained. Note that, if the paper is determined as being paper other than glossy paper in the first step in the first example, the next determination processing is needed to be executed, however, in the embodiment, if the paper is determined as being paper other than glossy paper, for example, thin paper or plain paper, the determination processing is no more needed to be executed. Therefore, according to the embodiment, there is an advantage that the processing can be ended in a short time in the case where glossy paper is scarcely used. Such a device can be arranged so that a user manually or automatically switches the operation as in the example utilizing the advantage.

THIRD EXAMPLE

Next, the third example of the invention will be described. The same components as in the first and second examples are assigned with the same signs and the description thereof will be omitted. In the example, the structure of the image reading sensor (CMOS area sensor) or the control flow of discrimination of kinds of paper is the same. While the amount of transmitted light is obtained by neglecting irregularities in the amount of light of the transmissive LED 302 in the operation method of the amount of transmitted light of the recording material in the above described first and second example, in the embodiment, the amount of transmitted light is calculated in consideration of irregularities in the amount of light.

Figure 11:
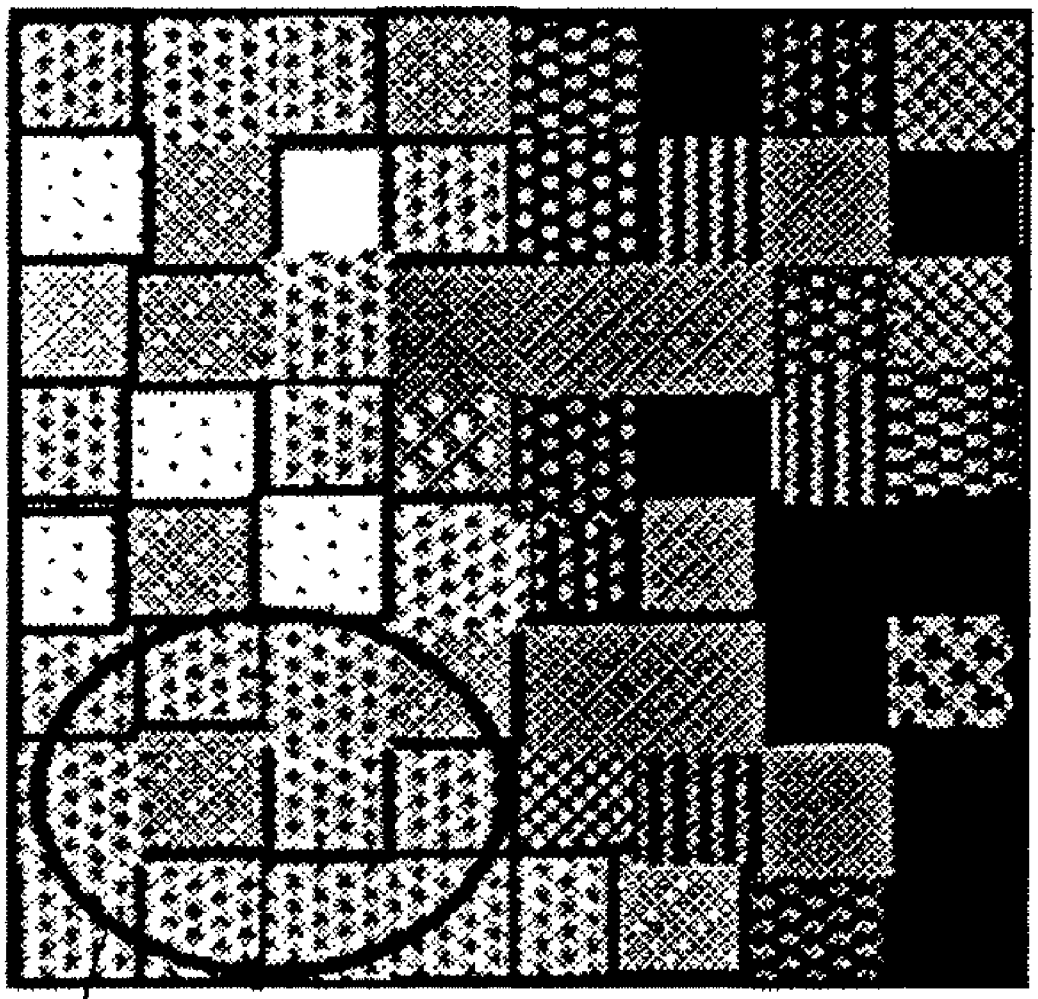
FIG. 11 shows an image obtained by reading the received light by the CMOS area sensor when the LED illuminates in the condition in which there is no recording paper and digitizing it.

In FIG. 11, an image obtained by reading the light received by the CMOS area sensor 211 when the LED 302 illuminates in the condition in which there is no recording paper and digitizing it is shown. Further, a control flow in the example is shown in FIG. 12.

Figure 12:
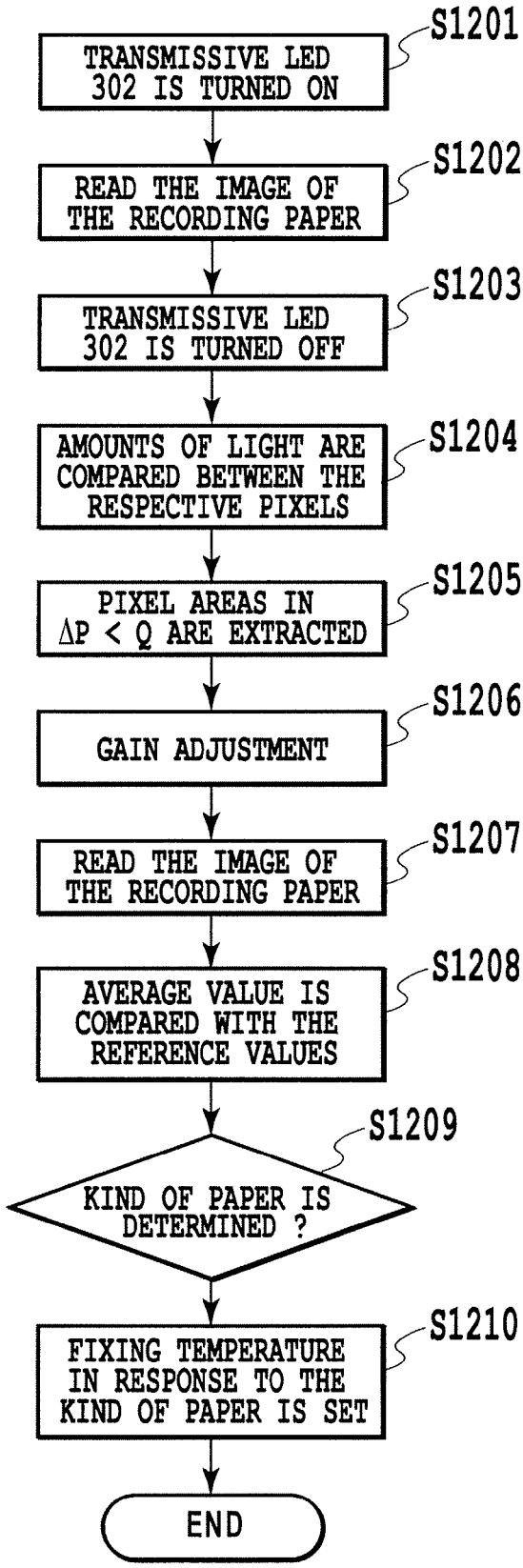
FIG. 12 is a flowchart showing a control flow by the control processor for executing fixing treatment condition control provided in the image forming apparatus according to the third example.

In FIG. 12, the operation in S1201 to S1203 is the same as in S901 to S903 and the description thereof will be omitted.

In the image obtained from the light received without having been transmitted through the recording material as in FIG. 11, amounts of light are compared between the respective pixels (S1204). Pixel areas having differences of output values of the respective pixels i ($\Delta Pi$=(maximum of $\Delta Pij$), here, $\Delta Pij = Pi - Pj$ where Pi and Pj are density in pixel i and density in a pixel adjacent to the pixel i, respectively) less than a constant value Q are extracted (S1205). In the pixel areas less than the constant value Q, average values of the amounts of light are obtained and they are stored in the memory as an EEPROM as reference values of the amount of transmitted light.

Next, up to the recording paper reaches within the area applied with light by the transmissive LED 302, the gain adjustment of the transmissive LED 302 is performed (S1206). The gain adjustment is performed by adjusting the gain of the analog output from the CMOS area sensor. That is, if the amount of transmitted light of the recording material is too large or too small, the gain adjustment is performed because the amount of transmitted light of the recording material can not be read sufficiently and the change in the amount of transmitted light can not be detected suitably. Then, the above gain adjustment is performed, the imaging is performed in a condition in which the recording paper is within the area applied with light by the transmissive LED 302 and the image is read (S1207). The amount of transmitted light of the recording material is obtained by obtaining the average value in the pixel area with few irregularities in the amount of light, which has been extracted as above, and the obtained amount of transmitted light is compared with the reference values that have been stored in advance (S1208). Then, the kind of recording material is determined (S1209) and the fixing temperature is set based on the determination result (S1210).

Thus, thin paper, plain paper, or heavy paper can be determined more accurately by relative comparison with the reference values of the amount of transmitted light that have been recorded in advance.

Second Embodiment

The embodiment is to provide a method for discriminating the kind of recording material further in detail compared with the above first embodiment.

Since the image forming apparatus, the constitution of each unit controlled by the CPU, and the circuit block diagram in the embodiment are the same as in the first embodiment, the description of the same components will be omitted.

Figure 15:
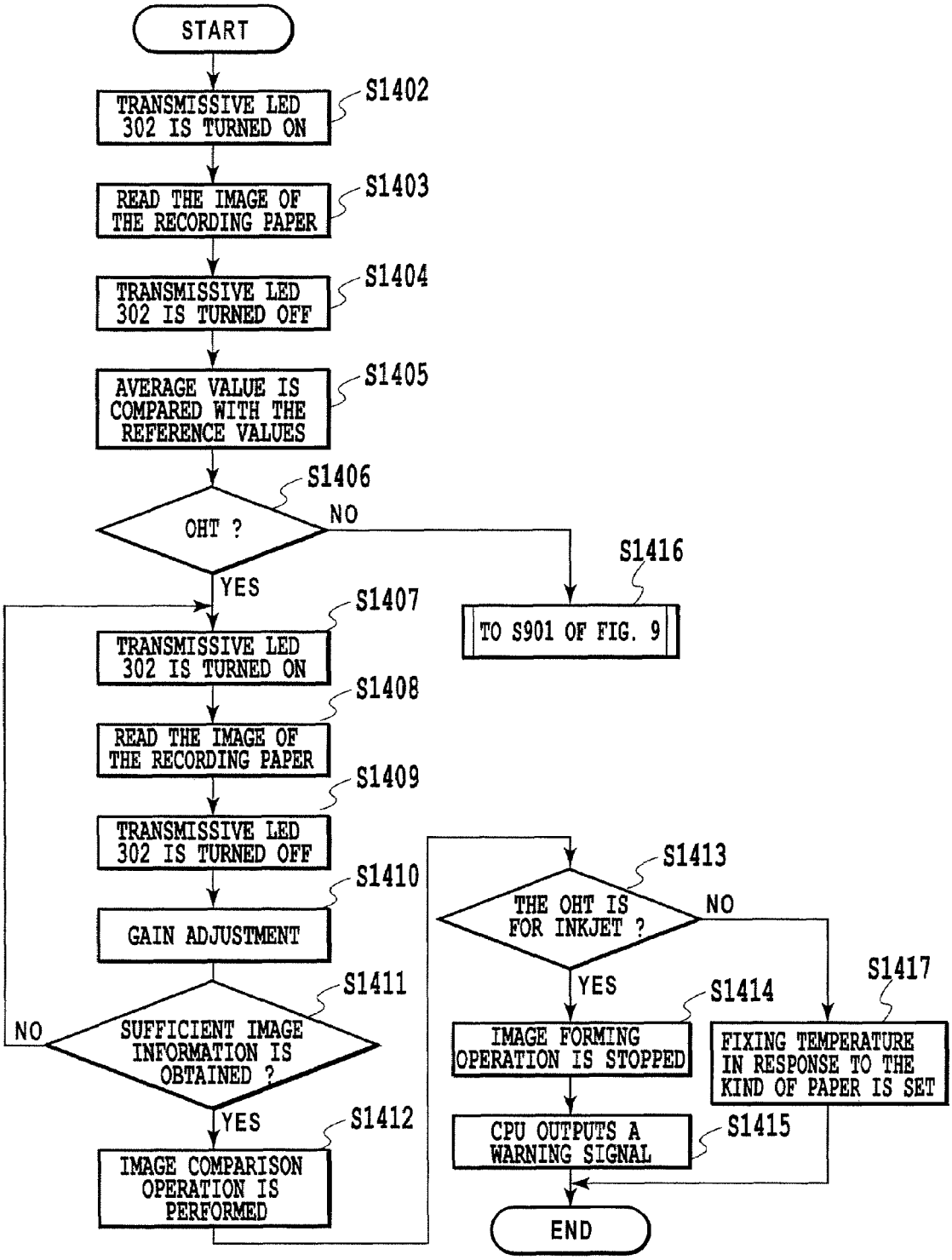
FIG. 15 is a control flow for recording material discrimination in the second embodiment.

FIG. 15 is a flowchart for discriminating the kind of recording material in the embodiment.

Although whether the material is an OHT or not is discriminated based on the amount of reflected light in the first embodiment, the embodiment is characterized in that, first, the transmissive LED is allowed to emit light and whether the recording material is an OHT or not is discriminated, and then, the discrimination method is switched depending on whether the recording material is an OHT or not, and the kind of recording material is discriminated.

First, the transmissive LED 302 is turned on (S1401) and the CMOS area sensor 211 reads the image of the recording material (S1402). Then, after the transmissive LED 302 is turned off, the amount of light obtained by being processed by the control circuit 702 is compared with the reference value (S1405). Here, the reference value is a predetermined value of the amount of light to be transmitted, and a value that is preset (set in a memory 224, for example) for discriminating whether the material is an OHT or not. Then, whether the amount is larger than the reference value or not, that is, whether the material is an OHT or not is discriminated (S1406).

As a result, if the amount is larger than the reference value, the material is determined as being an OHT. In this case, the reflective LED 301 is turned on (S1407) and the CMOS area sensor 211 reads the image of the surface of the OHT (S1408). The image reading is performed in plural times while carrying and stopping the recording material for gradual progress, and images are read at plural points and subjected to shading operation, and then, the recording material is stopped and the image is read. Then, after the reflective LED 301 is turned off (S1409), gain adjustment processing of the amount of light of the analog output from the CMOS area sensor and filter operation processing as noise removal processing of the A/D conversion result of the analog output are executed (S1410).

Figure 9:
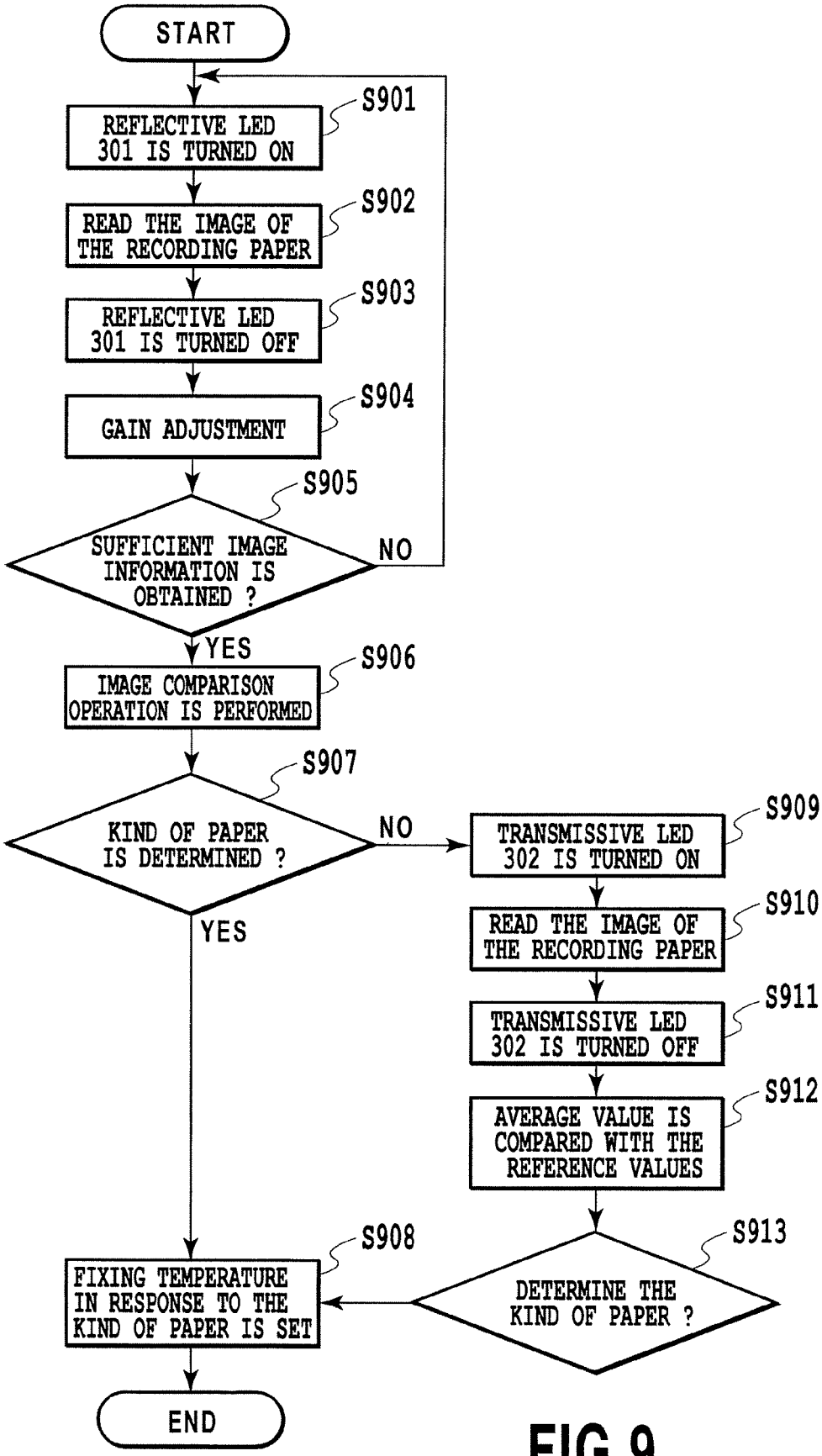
FIG. 9 is a flowchart showing a control flow by the control processor for executing fixing treatment condition control provided in the image forming apparatus according to the first example.

The gain adjustment and filter operation processing are the same processing as in S904 in FIG. 9 in the first embodiment, however, in the case of an OHT, because the amount of light to be reflected is smaller compared with the other recording materials, the gain adjustment is performed so as to obtain output from the CMOS area sensor 211 more compared with the recording material other than the OHT. Then, whether sufficient image information is obtained or not is determined from the operation result (S1411), if determined that the sufficient image information is obtained, image comparison processing is performed based on the image operation result that has been obtained by the processing (S1412). If determined that the sufficient image information is not obtained in S1411, the reflective LED 301 is turned on and image reading is executed again.

Here, the image comparison processing in S1412 will be described. In the case where the kind of OHT is discriminated, similarly, it is possible the surface condition of the recording material is read by the CMOS area sensor as an image for discrimination. Since an OHT for inkjet has larger projections and depressions on the surface thereof and the larger number of them than an OHT for laser beam printer, with respect to smoothness obtained by processing the image read by the CMOS area sensor, an inkjet OHT has lower value than the OHT for laser beam printer. The discrimination result is shown in FIG. 16.

Figure 16:
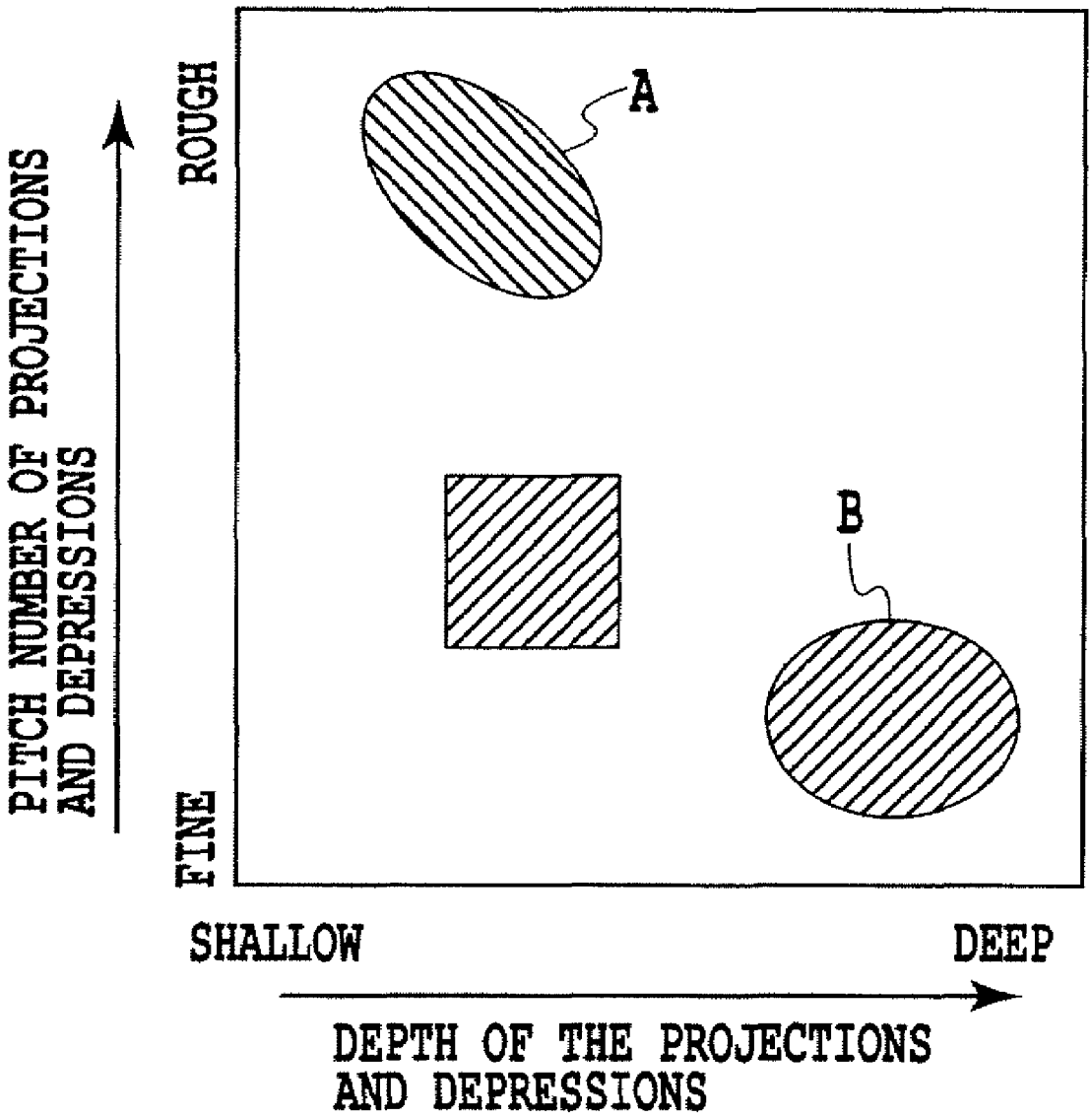
FIG. 16 shows the discrimination result of the kind of OHT in the second embodiment.

The vertical axis of FIG. 16 indicates the pitch number of projections and depressions obtained by processing the read image, and the horizontal axis indicates the depth of the projections and depressions. The pitch number of projections and depressions is a value obtained by converting the read image into digital values (binary values), extracting an edge number with respect to each line of the image, and integrating the edge numbers of all lines. Further, the depth of projections and depressions is a value obtained by extracting a maximum value Dmax and a minimum value Dmin of density with each line of the image and averaging the difference values of the maximum values Dmax and minimum values Dmin of the respective lines. Note that these processes are executed by the control circuit 702 and the CPU 201.

In FIG. 16, the OHT discrimination result for laser beam printer and the OHT discrimination result for inkjet are shown. The OHT corresponding to the value of the area A in the drawing is one having a rough pitch of projections and depressions and shallow depth of projections and depressions and determined as being an OHT for laser beam printer, and the OHT corresponding to the value of the area B in the drawing is one having a fine pitch of projections and depressions and deep depth of projections and depressions and determined as being an OHT for inkjet.

By the way, the reason for that the kind of OHT is thus discriminated is, in the case where the OHT for inkjet is carried and printed in a laser beam printer, because there is a receiving layer having a large number of projections and depressions for receiving ink in the OHT for inkjet, a defect that the receiving layer is heated and melted, and thereby, the OHT twines around the fixing roller of the fixing unit to cause a paper jam occurs. Accordingly, it is necessary to discriminate the kind of OHT, i.e., whether the OHT is for inkjet or not.

If the material is determined as being an OHT for inkjet (S1413) based on the result of the image comparison in S1412, image forming operation is stopped (S1414), the CPU outputs a warning signal (S1415) so as to perform warning display on an operation panel (not shown) or the like of the image forming apparatus based on the warning signal for notification to the user, and thereby, the defect that the OHT for inkjet is printed and twines around the fixing roller of the fixing part to cause a paper jam can be prevented from occurring. On the other hand, if the material is determined as being not an OHT for inkjet in S1413 (in the case of an OHT for laser beam printer), image forming operation is controlled by setting the condition of the fixing temperature in response to the OHT.

Further, if the material is determined as being not an OHT in S1406, the discrimination of the kind of recording material according to the flowchart from S901 to S903 in FIG. 9, which has been described in the first embodiment, is performed. Although description of the flowchart in FIG. 9 is omitted because it has been described in detail in the first embodiment, here, the kind of recording material is discriminated based on the image of the surface condition and the amount of transmitted light of the recording material while sequentially turning on the reflective LED 301 and the transmissive LED 302.

That is, in the embodiment, first, the transmissive LED is allowed to emit light to judge whether the recording material is an OHP sheet or not. Subsequently, if the material is an OHP, the kind of OHT is discriminated while not turning on the transmissive LED but turning on the reflective LED, and, if it is a recording material other than the OHT, the kind of recording material is discriminated by turning on the reflective LED and the transmissive LED for discrimination of the kind of recording material so as to switch the method of discrimination.

By the way, the first emission time of the transmission LED and the subsequent emission time of the transmission LED in the case where the material is a recording material other than the OHT are different, and the first emission time of the transmission LED is shorter than the subsequent emission time of the transmissive LED. This is because the first emission of the transmission LED is only for discrimination whether the material is an OHT or not and there is clearly a large difference in the amount of transmitted light between the cases of an OHT and not (e.g., plain paper) (the amount of transmitted light of an OHT is considerably larger), and thereby, whether the material is an OHT or not can be discriminated in a shorter emission time than the emission time for subsequently detecting the thickness of the recording material other than the OHT.

Further, the reason for first discriminating whether the material is an OHT or not while allowing the transmissive LED to emit light is as follows. It is known that, in the case where the recording material is discriminated using transmitted light and reflected light, the time for discriminating the kind of OHT becomes especially longer of the discrimination. This is because, in the case of an OHT, the amount of light reflected from the surface is considerably less than in the case of a material other than the OHT, and the surface image thereof can not be discriminated accurately unless the LED is allowed to emit for a long time and the reflected light is detected for a long time.

Further, set values of gain adjustment from the above described CMOS area sensor 211 are different between the cases of an OHT and a recording material other than the OHT. This is because the amount of reflected light from the OHT is considerably less than the amount of reflected light from a recording material other than the OHT, and, if the gain adjustment is performed at the same level, image identification in either case becomes difficult. For example, in the case where an image of a recording material other than the OHT is imaged under the gain adjustment setting for the OHT, the output from the CMOS area sensor is saturated due to the large amount of reflected light and discrimination becomes difficult. On the contrary, in the case where an image from an OHT is imaged under the gain adjustment setting for a recording material other than the OHT, the discrimination also becomes difficult because the obtained output is too small.

Therefore, whether the case of an OHT or not is first determined by allowing the transmissive LED to emit light, and then, gain adjustment in response to either of them is performed.

Further, in the case where the surface image of a recording material is detected, in order to correct the irregularities in the amount of light of the LED and a mounting error of the LED, it is necessary to detect the surface image based on the reflected light that has been measured in plural times while moving the recording material little by little and perform shading operation for obtaining correction data based on the detected surface images of the plural times. In this shading operation, similarly, because the amount of reflected light is considerably less than a recording material other than the OHT, the LED emission time and detection time are needed to made longer.

Figure 17:
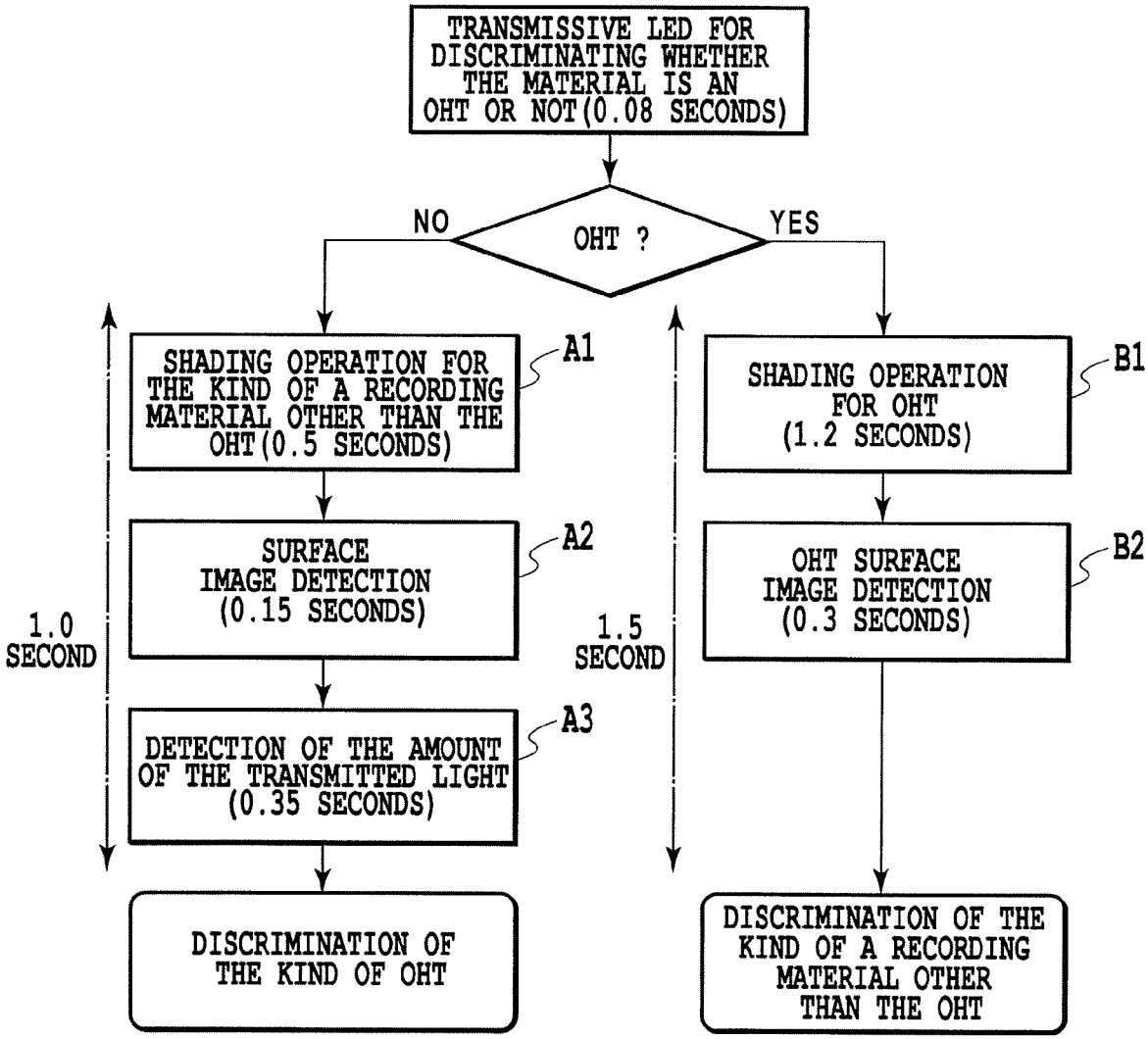
FIG. 17 shows times necessary for recording material discrimination of the second embodiment.

FIG. 17 shows times necessary for recording material discrimination of the embodiment. As shown in FIG. 17, shading operation (B1: 1.2 seconds) and OHT surface image detection (B2: 0.3 seconds) are required for discrimination of the kind of OHT and a total of 1.5 seconds is required, while, for the discrimination of the kind of a recording material other than the OHT, shading operation (A1: 0.5 seconds), surface image detection (A2: 0.15 seconds), and detection of the amount of the transmitted light (A3: 0.35 seconds) are required and a total of 1.0 second is taken.

Here, for example, comparing the times for shading operation, it is known that the case of an OHT requires twice or more as much as the time for the case of the material other than the OHT (A1: 0.5 seconds<B1: 1.2 seconds). By the way, as shown in FIG. 17, the emission time (detection time) of the transmissive LED for discriminating whether the material is an OHT or not is considerably shorter time (0.08 seconds) than the times for other processes.

Thus, since the processing time is required for the discrimination of the kind of OHT, the control for first discriminating whether the material is an OHT or not in a short time using the transmissive LED, and then, switching the method of discrimination between the cases of an OHT and a material other than the OHT is performed.

Here, for example, it is conceivable that the thickness detection processing (A3) of a recording material other than the OHT using transmitted light combines with the discrimination whether the material is an OHT or not. In such a case, the time taken for identifying the recording material other than the OHT can be shortened, but, contrary, the time taken for discriminating the kind of OHT becomes longer (A3: 0.35 seconds+B1: 1.2 seconds+B2: 0.3 seconds=1.85 seconds). This extends the time up to the start of printing if the kind of OHT is discriminated and discriminated as being an OHT for laser printer, and productivity is no good. Further, the time up to the stop of the apparatus when the material is determined as being an inkjet OHT, time is taken till an error occurrence is indicated.

Therefore, as described above, there is an advantage that times for identification of the recording material, especially, the time for discriminating the kind of OHT can be shortened by (1) OHT discrimination by the transmissive LED emission and (2) determination whether the reflective LED and the transmissive LED are used or the reflective LED is used without using the transmissive LED depending on whether the material is an OHT or not.

As described above, according to the invention, thin paper, plain paper, heavy paper, glossy paper, a glossy film and the kind of OHT can be discriminated and more kinds of recording materials can be discriminated.

Further, according to the invention, the time for discriminating the kind of recording material can be shortened.

Third Embodiment

Using FIG. 13, the third embodiment of the invention will be described. Note that, since the operation method and the control method are the same as in the above described first embodiment, the description of the same parts as in the first embodiment will be omitted using the same signs and only the different constitution from that in the first embodiment will be described.

Figure 13:
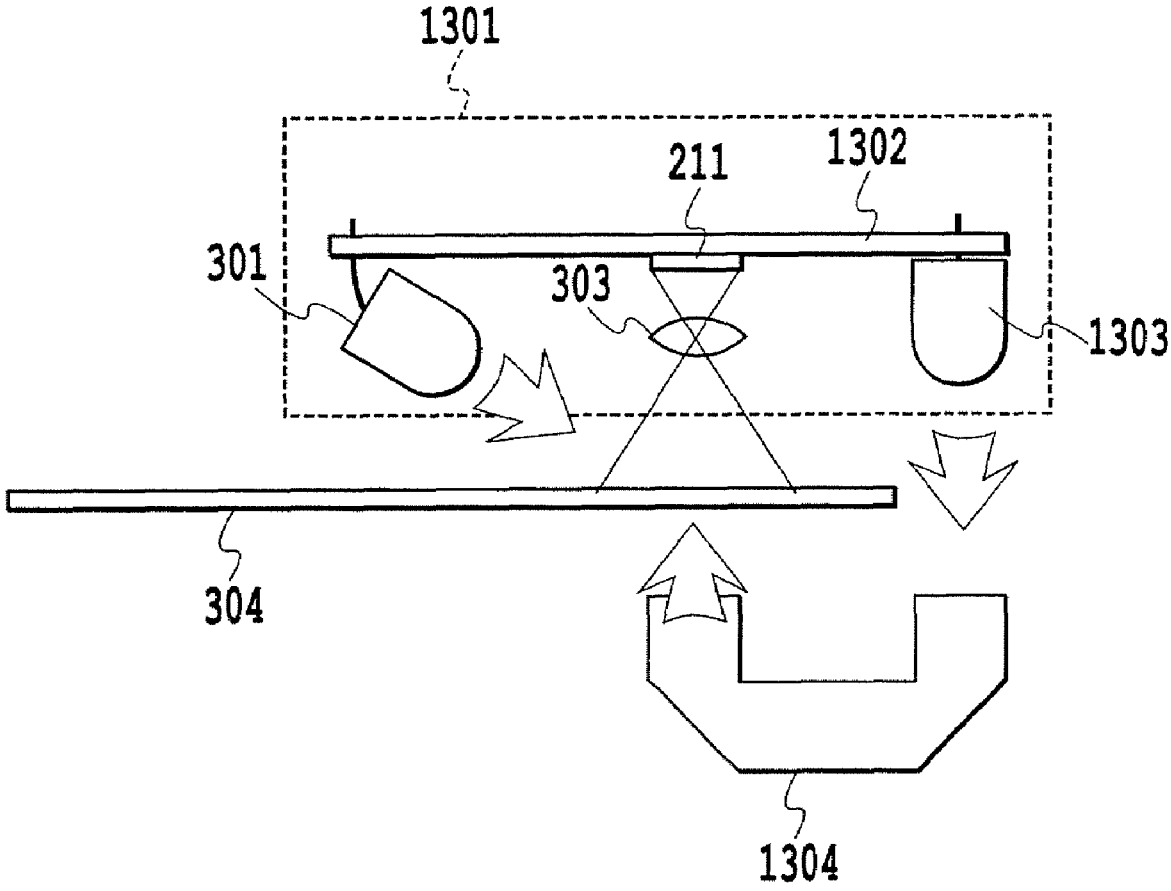
FIG. 13 is a schematic sectional view showing the general constitution of the third embodiment.

FIG. 13 is a schematic sectional view showing the general constitution of the third embodiment. In FIG. 13, a sensor unit 1301 includes a substrate 1302 on which the reflective LED 301, a transmissive LED 1303, and a sensor chip 211 are mounted, and a lens 303. Here, the reflective LED 301 is mounted diagonally relative to the substrate as shown in FIG. 13. By the way, the LED can be allowed to illuminate diagonally by a light guide (not shown), not diagonally mounted.

The light output from the transmissive LED 1303 mounted on the substrate 1302 repeats the reflection by the light guide 1304, and applies light to the recording material from the opposite side of the sensor. Thereby, an equal advantage to the transmissive LED 302 in the first embodiment can be achieved.

According to the embodiment, since electric components can be located along one direction relative to the recording material in a concentrated manner, the cost can be reduced, and in addition, the restriction of wiring paths and the restriction of mountability can be relieved because there is no need to wire on the light guide 1304 side.

Fourth Embodiment

Using FIG. 14, the fourth embodiment of the invention will be described. Note that, since the operation method and the control method are the same as in the above described first embodiment, the description of the same parts as in the first embodiment will be omitted using the same signs and only the different constitution from that in the first embodiment will be described.

Figure 14:
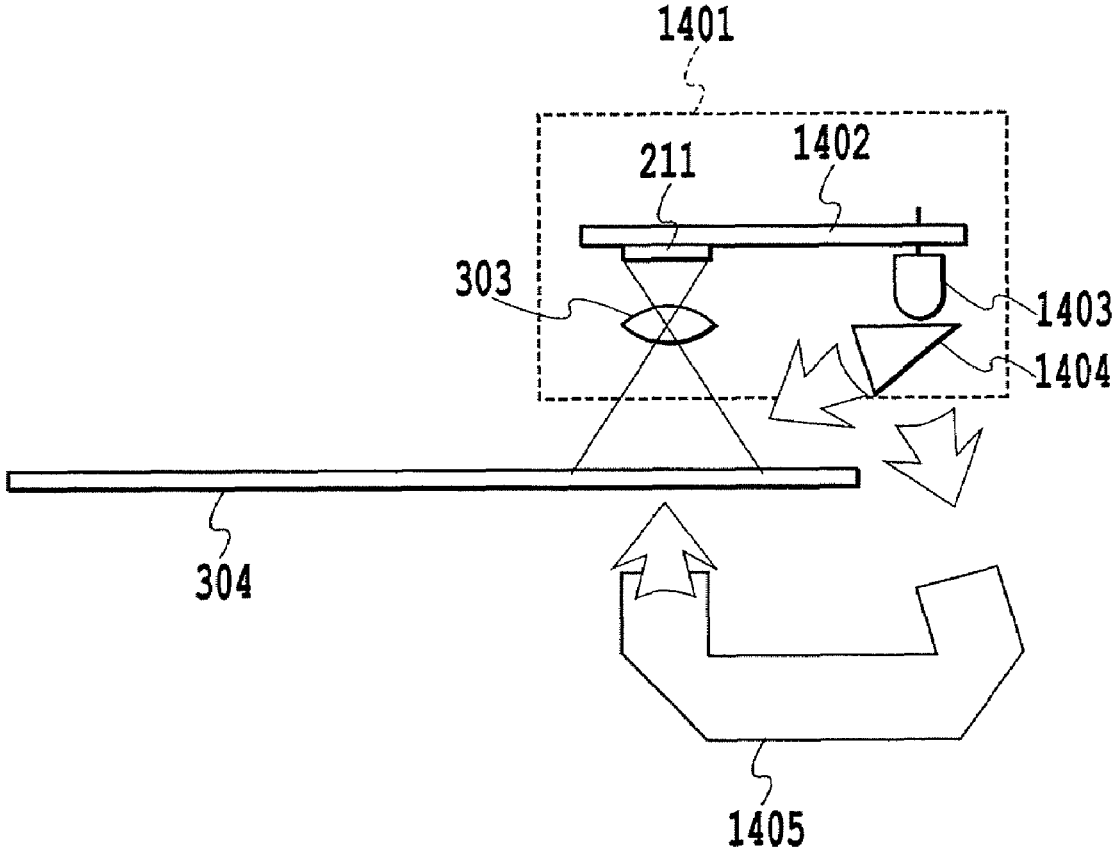
FIG. 14 is a schematic sectional view showing the general constitution of the fourth embodiment.

FIG. 14 is a schematic sectional view showing the schematic constitution of the fourth embodiment. In FIG. 14, a sensor unit 1401 has a substrate 1402 on which a reflective/transmissive LED 1403 and a sensor chip 211 are mounted, and further has a lens 303 and a prism 1404.

The light output from the reflective/transmissive LED 1403 mounted on the substrate 1402 is divided into light for reflection and light for transmission, and the light for reflection illuminates a detection area and the light for transmission repeats the reflection by a light guide 1405, and applies light to the recording material 304 from the opposite side of the sensor. Thereby, an equal advantage to the transmissive LED 302 in the first embodiment can be achieved.

According to the embodiment, since electric components can be located along one direction relative to the recording material in a concentrated manner and the light source is consolidated into one, the cost can be reduced, and in addition, the restriction of wiring paths and the restriction of mountability can be relieved because there is no need to wire on the light guide 1304 side.

As described above, according to the invention, a recording material discrimination device including: a reflected light determination unit including an image reader for obtaining an image of a surface of a recording material by reading reflected light reflected from the surface of the recording material, and determining a first attribute of the recording material using the image of the surface of the recording material obtained by the image reader and a transmitted light determination unit for determining a second attribute of the recording material using transmitted light transmitted through the recording material is provided, and a kind of the recording material is discriminated based on the first attribute and the second attribute. Since the kind of recording material can be discriminated accurately, good fixed images can be obtained by performing fixing in an optimum fixing condition even with various kinds of recording materials or the like while improving usability.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application Nos. 2003-346278 filed Oct. 3, 2003 and 2004-269028 filed Sep. 15, 2004, which are hereby incorporated by reference herein.

What is claimed is:

1. An image forming apparatus including an image forming part for forming an image onto a recording material, the image forming apparatus comprising:

a first irradiating portion for irradiating a recording material with a light so as to obtain reflected light reflected from a surface of the recording material;

a second irradiating portion for irradiating the recording material with a light so as to obtain transmitted light transmitted through said recording material;

an image reading device for reading the reflected light as a first image which has a plurality of pixels and reading the transmitted light as a second image which has a plurality of pixels at a different timing; and a discrimination portion for determining a kind of the recording material based on the first image or the second image.

2. The image forming apparatus according to claim 1, wherein the discrimination portion determines the kind of the recording medium based on data which digitized the first image or the second image.

3. The image forming apparatus according to claim 1, wherein the discrimination portion determines a kind of the recording material based on smoothness of the recording material according to a concentration difference of the pixels in the first image and thickness of the recording material according to an amount of light of the pixel in the image.

4. The image forming apparatus according to claim 1, wherein the image forming part includes a latent image carrier for carrying a latent image, a developing part for developing said latent image, a transfer part for transferring a developer image onto said recording material, and a fixing device for fixing said developer image on said recording material, which has been transferred by said transfer part, and the apparatus further comprises a controller for setting a transfer condition of the transfer part or a fixing condition of the fixing device based on the kind of the recording material.

5. The image forming apparatus according to claim 1, wherein said reading device is a CMOS area sensor or a CCD sensor.

6. An image forming apparatus including an image forming part for forming an image onto a recording material, the image forming apparatus comprising:

a first irradiating portion for irradiating a recording material with a light so as to obtain reflected light reflected from a surface of the recording material;

a second irradiating portion for irradiating the recording material with a light so as to obtain transmitted light transmitted through the recording material;

an image reading device for reading the reflected light as a first image which has a plurality of pixels and reading the transmitted light as a second image which has a plurality of pixels at a different timing; and a controller for setting an image forming condition of the image forming part based on an image in the area according to the reflected light and an image in the area according to the transmitted light.

7. The image forming apparatus according to claim 6, wherein said image forming apparatus including a latent image carrier for carrying a latent image, a developing part for developing said latent image, a transfer part for transferring a developer image onto a recording material, and a fixing device for fixing said developer image on the recording material, which has been transferred by said transfer part, and a transfer condition of the transfer part or a fixing condition of the fixing device is based on the first image or the second image.

8. The image forming apparatus according to claim 6, wherein said reading device is a CMOS area sensor or a CCD sensor.

9. The image forming apparatus according to claim 1, wherein the discrimination portion uses the first image or the second image selectively to determine a kind of the recording material.

10. The image forming apparatus according to claim 1, wherein the discrimination portion uses the second image to determine a first attribute of the recording material at first and by using the determined first attribute, decides whether or not to use the first image to determine a second attribute of the recording material.

11. The image forming apparatus according to claim 1, wherein the discrimination portion uses the first image or the second image selectively to set the image forming condition.

* * * * *